United States Patent [19]

Ferris

[11] 4,344,742

[45] * Aug. 17, 1982

[54] ENGINE APPARATUS

[76] Inventor: James J. Ferris, 39 N. High St., Clinton, Conn. 06403

[ * ] Notice: The portion of the term of this patent subsequent to Feb. 20, 1996, has been disclaimed.

[21] Appl. No.: 966,097

[22] Filed: Dec. 4, 1978

Related U.S. Application Data

[63] Continuation of Ser. No. 644,751, Dec. 29, 1975, Pat. No. 4,140,440, Continuation-in-part of Ser. No. 537,116, Dec. 30, 1974, abandoned.

[51] Int. Cl.[3] ..... F04B 17/00; F04B 35/00; F02B 25/08

[52] U.S. Cl. ..... 417/343; 417/364; 417/380; 74/110; 74/520; 123/197 AC; 123/197 AB

[58] Field of Search ..... 417/343, 364, 380, 339; 123/197 AC, 197 AB; 74/520, 521, 110

[56] References Cited

U.S. PATENT DOCUMENTS

| | | | |
|---|---|---|---|
| 2,601,756 | 7/1952 | Bright | 417/364 X |
| 2,610,785 | 9/1952 | Carlson | 417/343 |
| 2,661,592 | 12/1953 | Bright | 123/46 SC |
| 2,736,488 | 2/1956 | Dros | 417/343 X |
| 3,274,982 | 9/1966 | Noguchi et al. | 123/53 B |
| 3,859,966 | 1/1975 | Braun | 417/343 X |

*Primary Examiner*—Richard E. Gluck
*Attorney, Agent, or Firm*—Roland T. Bryan

[57] ABSTRACT

This invention relates to internal combustion engines, the energy output of which is produced as hydraulic pressure, and in one embodiment comprises two, two-cycle internal combustion engines which face each other, the piston rods of each of which are axially aligned and are linked to both of the axially aligned drive pistons of two hydraulic pumps which also face each other by means of four connecting rods of equal length, the axis of the pump rods being at right angles to that of the engine rods, and associated hydraulic circuitry which includes means for selectively initiating the compression phase of the engines when their respective pistons have thrust outward toward each other to such an extent that the angle between the axis of each of said piston rods and its associated connecting rods has passed through a right angle and said rods would otherwise be retained in said extended position through force exerted on said connecting rods by the pistons of the hydraulic pumps.

2 Claims, 21 Drawing Figures

TOP DEAD CENTER (FIRING)
HIGH PRESSURE
LOW PRESSURE
FUEL INJECTION
AIR SCAVENGING
EXHAUST

BOTTOM DEAD CENTER (OPF)
HIGH PRESSURE
LOW PRESSURE
FUEL INJECTION
AIR SCAVENGING
EXHAUST

BOTTOM DEAD CENTER COMPRESSION (STARTING)

HIGH PRESSURE
LOW PRESSURE
FUEL INJECTION
AIR SCAVENGING
EXHAUST

COMPRESSION
(MID-STROKE)

COMBUSTION

COMPRESSION

ENGINE APPARATUS

BACKGROUND OF THE INVENTION

This application is a continuation of Ser. No. 644,751 filed Dec. 29, 1975, now U.S. Pat. No. 4,140,440, itself a continuation-in-part of Ser. No. 537,116, filed Dec. 30, 1974, now abandoned.

The present invention relates to means by which internal combustion can be harnessed hydraulically. There are several advantages sought to be achieved with a hydraulic engine. The velocity of the engine and its thermodynamic cycle may be made independant from the rate at which work is being done, thus making it possible for the engine to run only at its most efficient speed. The hydraulic storage of compression energy makes it possible for the engine to shut off without losing the energy necessary for its next compression stroke. It is possible to restart using only the compression energy stored on the last power stroke. It is possible to start the engine under full load. The necessity for engine idling may be eliminated. The compression stroke may be made independant from the power stroke. Piston motion may be freed from the restrictions of a rotating crank. A greater variety of combustion conditions is possible, including constant volume. The work potential of the engine output may be stored. Regenerative breaking may be practiced. Many engines may be easily combined to achieve massive outputs. Massive failure may be substantially reduced. The total system in which the engine operates may be made to produce for limited times horsepower in excess of the output of the engine alone. Additionally, any or all of the above may be accomplished in combination and result in a substantial reduction in energy consumption and pollution without corresponding reduction in performance.

In the past, attempts to achieve this objective have run into various problems, including vibration, high fluid friction, excessive valve losses, problems with seals, hydraulic complexity, mechanical complexity and starting and restarting inefficiency.

In this connection, and as examples of prior art devices in this field, reference is made to the following U.S. Pat. Nos.; Bright 2,601,756; Bright 2,661,592; Carder et al 2,978,986; Eickmann 3,174,432; Eickmann 3,260,213; Eickmann 3,269,321 and Korper 3,769,788. Accordingly an object of the present invention is to provide a motor means which combines high efficiency in operation with high efficiency in starting and restarting.

In addition, in the prior art, U.S. Pat. No. 3,274,982, shows a pair of opposed feed pumps cylinders and a pair of opposed combustion cylinders the centerline of which intersects the centerline of the feed pump cylinders at a right angle. The cylinders are spaced radially around the engine drive shaft to form a cruciform. The engine has a drive shaft provided with a rotating control cam to successively actuate each piston rod of each engine and pump piston. Linkages are provided connecting adjacent antifriction rollers on the bottom of each piston rod to form a parallellogram so that the roller of each piston is kept in contact with the cam surface of the drive shaft. This engine is conventional in that it has a drive shaft as a power take-off and a cam for timing.

This device incurs for disadvantages of conventional internal combustion engines in that it is dependent on the momentum of a rotary shaft. The power on the compressor stroke is supplied by the energy in the rotating shaft via the cam mechanisms. The present invention eliminates the need for a cam and rotary, momentum, and instead, directly drives the compression by hydraulic pressure.

Moreover, the fuel pump pistons (U.S. Pat. No. 3,274,982) do not absorb in the pumped fluid the entire energy of the power stroke. The rotary shaft absorbs a large part of such energy.

A further object is to provide a means for starting and stopping a motor means whereby there is no need for locking valves across any of the major circuits.

Another object is to provide a motor means having improved dynamic balance.

Yet another object is the provision of a means whereby an engine can operate over a range of pressures without substantial variation in the length of the stroke.

A further object of this invention is the accomplishment of desired objectives by a geometrically unique, and structurally simple means.

SUMMARY OF THE INVENTION

Desired objectives may be achieved through practice of this invention, embodiments of which include two facing hydraulic piston pumps, the piston rods of which are aligned on the same axis, two-cycle internal combustion engine means located intermediate to and back from said pumps, and having thrust delivering piston means the axis of which is at right angles to the axis of the pump pistons, each such engine piston being connected to both of said pump pistons by connecting rods of equal length, and associated hydraulic circuitry including means for selectively forcing each of said engine pistons back into its associated engine after it has thrust outward to such an extent that the angle between it and its associated connecting rods has passed through 90° and other-wise would be retained in said extended position because of force exerted thereon by the hydraulic pump pistons acting through said connecting rods.

DESCRIPTION OF DRAWINGS

This invention may be more clearly understood from the description which follows, and from the accompanying drawings, in which

FIG. 15 is a cross-section of another embodiment of this invention showing one combustion piston connected to two pumping pistons.

FIG. 16 is a modification of the embodiment of this invention shown in FIG. 2, the modification consisting of the inclusion of a spring in output pumping chamber 13.

FIG. 17 is a partial cross-section of a modification of the embodiment shown in FIG. 1 showing an intake valve in the combustion cylinder head, a hydraulic piston mounted in the combustion cylinder wall for the purpose of recycling the engine back to bottom dead center, in the event of a misfire, and intermeshing gear teeth on the pumping piston end of the connecting rods, for the purpose of synchronizing the combustion pistons at and around bottom dead center.

FIG. 18 illustrates another embodiment of this invention in which no pumping pistons are immediately behind the combustion pistons; and is a cross-section of the embodiment of this invention shown in FIG. 19 taken along the combustion and output pumping axis, with the engine at bottom dead center.

FIG. 19 is a cross-section of the embodiment of this invention shown in FIG. 18 taken along the combustion and compression function axis, with the engine at bottom dead center.

FIG. 20 is a cross-section of still another embodiment of the invention showing four combustion pistons connected to four pumping pistons by connecting rods in such a way as to permit the power stroke of one pair of combustion pistons to both pump and drive the compression stroke of the other pair of combustion pistons and the suction stroke a second pair of pumping pistons.

FIG. 21 is a cross-section of the embodiment shown in FIG. 20 taken along section BB showing with greater clarity the relationship of the pumping pistons to each other and the combustion pistons which drive them.

DESCRIPTION OF PREFERRED EMBODIMENTS

Figure 1:
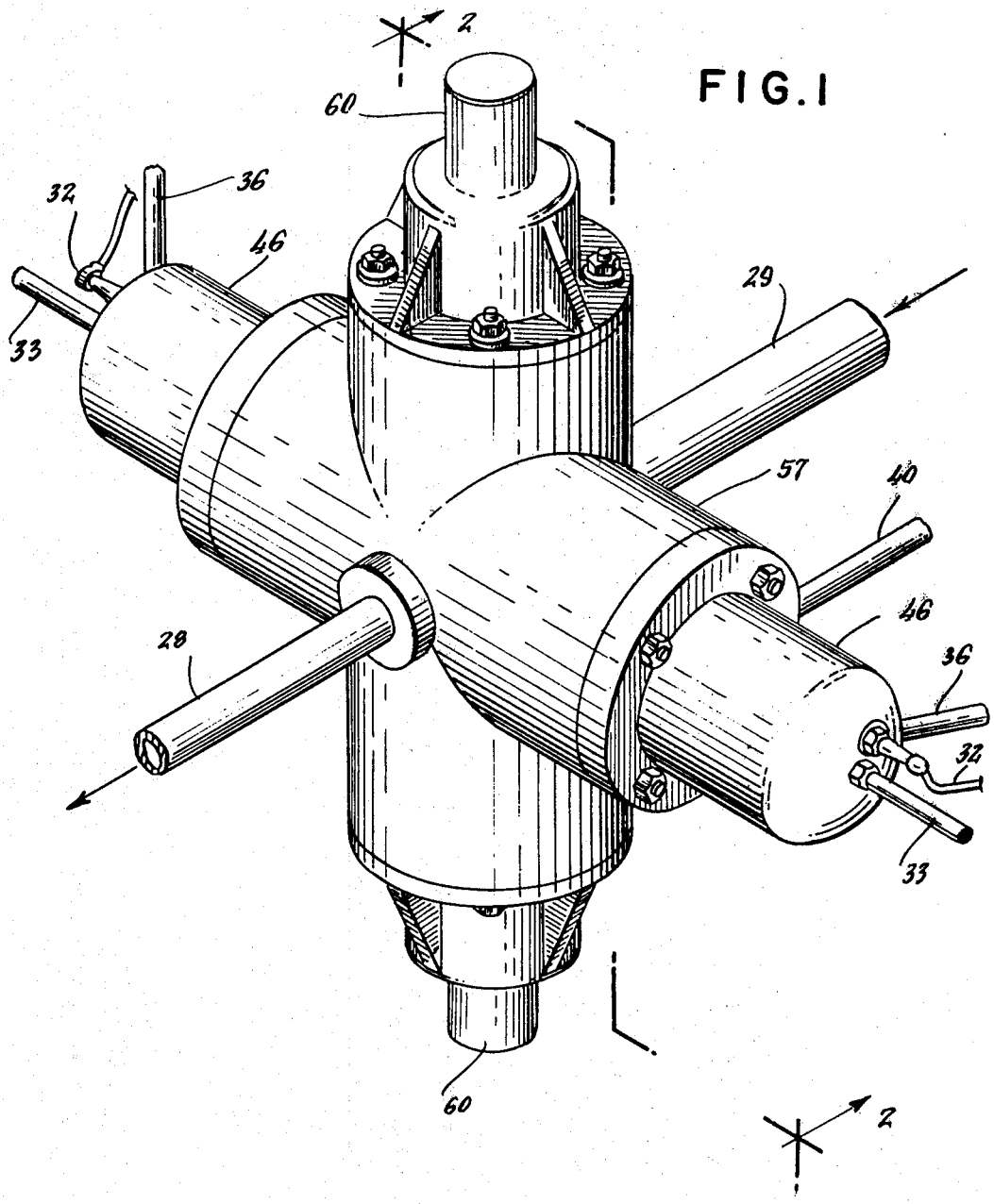
FIG. 1 is a perspective view of one embodiment of the present invention.

Referring first to FIG. 1, there is depicted apparatus which embodies the present invention. It consists of a main engine housing 57 having opposing combustion cylinder heads 46 oriented on a common axis that is normal to opposing hydraulic cylinder heads 60, which are also oriented on a common axis; both of said axes being generally normal to the axis of openings which provide access to the housing 57 for a main low pressure hydraulic fluid line 29 and a main high pressure hydraulic fluid line 28. Also shown in FIG. 1 associated with the combustion cylinder heads 46 are fuel injector lines 33, ignition wires 32 connected to internal glow plugs, an exhaust pipe 40, and a hydraulic fluid conduit 36 by which the combustion chambers may be cooled and the hydraulic fluid heated as hereinafter described.

Figure 2:
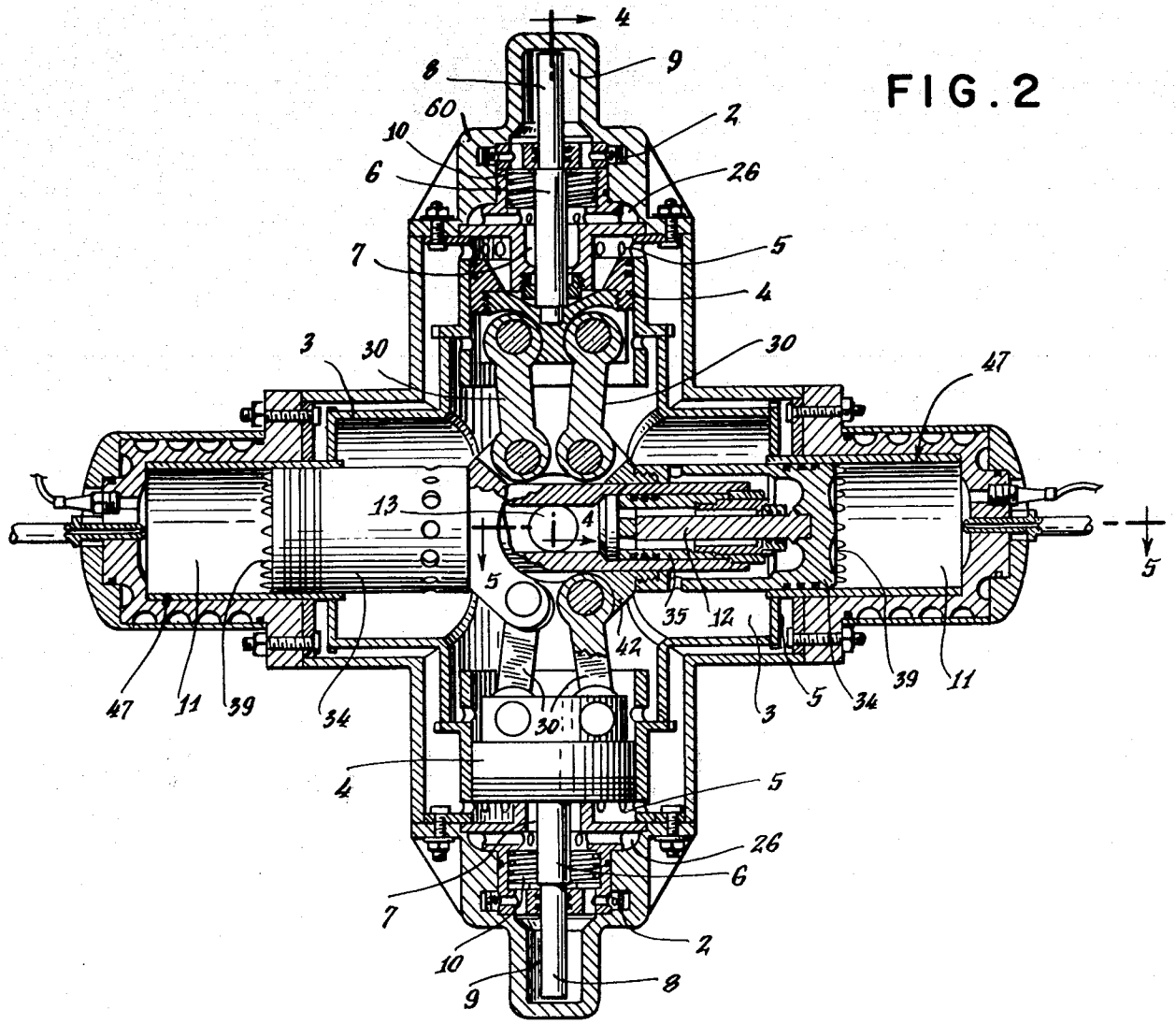
FIG. 2 is a cross-section of the embodiment of this invention shown in FIG. 1 with the engine at bottom dead center.

Turning to FIG. 2, there is illustrated a partial cross-section of the apparatus shown in FIG. 1 taken along a plane bisecting the combustion and hydraulic cylinders when the engine is at the bottom dead center position. Referring first to the motor which is shown oriented on the vertical axis, each cylinder liner 47 describes a combustion chamber 11 with exhaust ports 39, in which is positioned a combustion piston 34 connected to connecting rods 30, and having associated therewith a pumping piston 12 and another pumping piston 8. The connecting rods 30 in turn are connected to the scavenging pistons 4 positioned within hydraulic cylinder housings, the outermost ends of which form compression chambers 5 through which pass compression function piston rods 6 that reside in compression function chambers 7 and connect the pistons 4 to pumping pistons 8 positioned within the pumping chambers 9. Also included within the hydraulic cylinder housing 60 are check valves 2, 10, the function of which is hereinafter described, and channels 26. Positioned within each of the combustion pistons 34 is a large diameter second stage piston 35 connected to the pistons 34 by means of pumping pistons 12, one end of which is exposed to combustion piston drive chamber 13.

As shown in FIG. 2, the combustion pistons 34 are at their bottom dead center positions, by virtue of which, through interaction of the connecting rods 30, the hydraulic pistons 8 are in positions of maximum extension.

While it is recognized that it is possible for the engine to run with a single stage hydraulic piston axially connected to the back of the combustion piston, FIG. 2 shows a two stage piston, the second stage making it possible for the engine to operate over a wider pressure range without a substantial variation in the length of the stroke. As the first stage pistons 12 converge during the power stroke, they reach a point where they contact the larger diameter second stage pistons 35. This larger diameter pumping quickly absorbs the remaining energy of the power stroke when the associated hydraulic system is at high pressure, the energy of combustion is absorbed at a greater rate per unit of distance traveled on the power stroke, thus by the time the first stage pumping pistons 12 reach the point where the second stage pumping pistons 35 become operative there is little or no energy left to absorb and the power stroke ends at that point without the second stage pumping pistons 36 coming into play. At lower pressures, however, a stroke of the same total power will have combustion energy still undissipated at that point and the second stage pumping pistons 35 will travel whatever additional length is necessary to absorb it. It is recognized that it is also possible to hold the length of the stroke constant for a variation in system pressure by varying the fuel input, and while it is forseen that there will be applications where that method is desirable, the means shown reduces the need for operator or governor control of the engine where fuel is concerned, thus it is possible for the engine always to be operating at or near optimum thermodynamic cycle.

Figure 4:
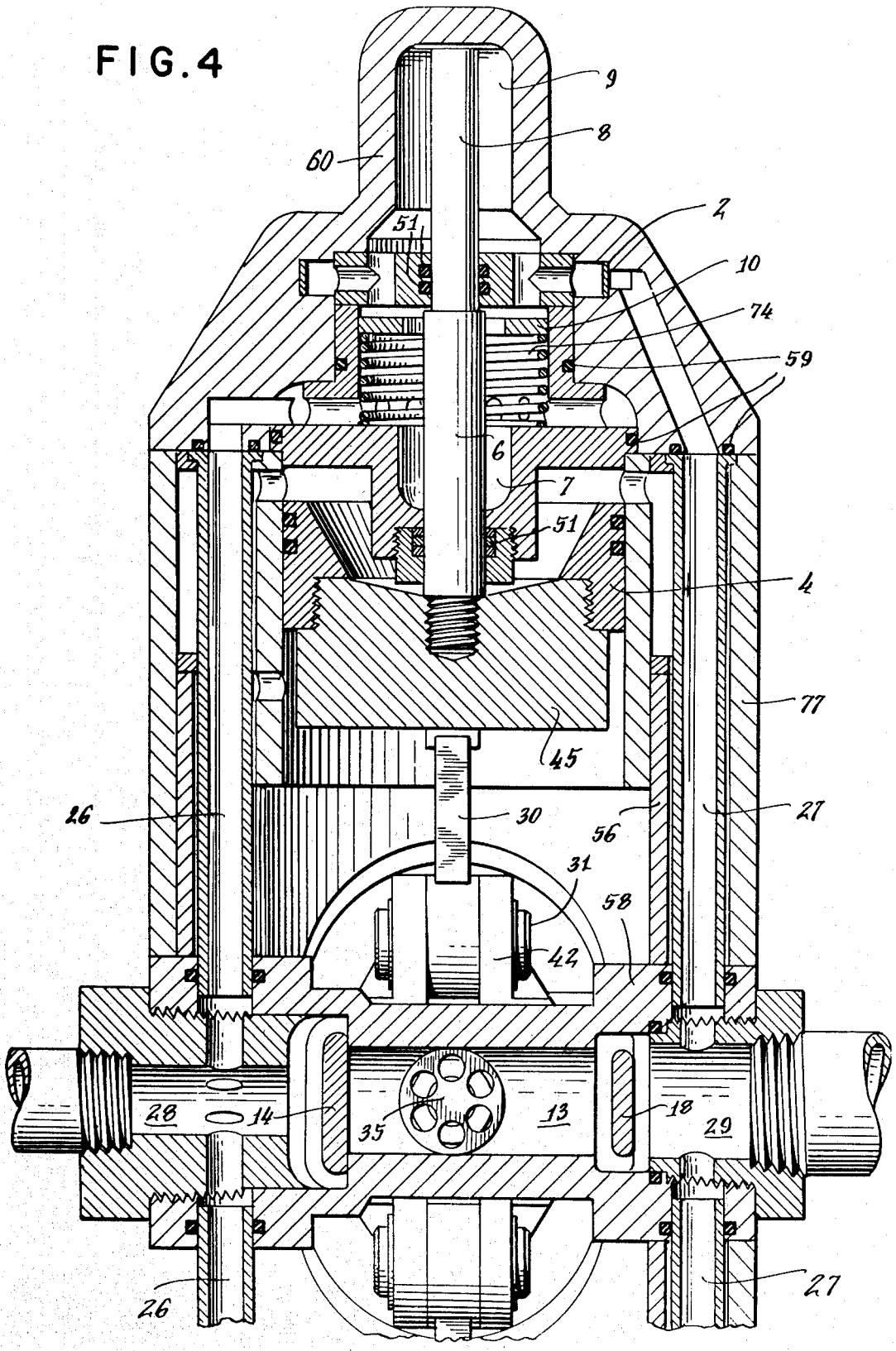
FIG. 4 is a cross-section of the embodiment of this invention shown in FIG. 1 taken along the pumping and fluid flow axes, with the engine at bottom dead center.

FIG. 4 illustrates a partial cross-section of the embodiment shown in FIGS. 1 and 2, also at the point in operation where the engine is at the bottom dead center position with the stepped pumping pistons 4, 6, 8 fully extended, except that FIG. 4 is a cross-section taken through the hydraulic cylinder housings 60 and the hydraulic fluid lines 28, 29. In addition to components as illustrated and designated in FIGS. 1 and 2, FIG. 4 illustrates dynamic seals 51, a check valve 2 in the closed position, a check valve 10 in the open position it would be in during the power stroke, check valve main spring 74, static hydraulic seals 59, piston rod yokes 42, 45, connecting rods 30, wrist pins 31, check valves 14, 18, and second stage output pumping piston 35, crankcase inner liner 56, low pressure inlet 29, outlet check valve 14, and low pressure check valve 18.

Figure 5:
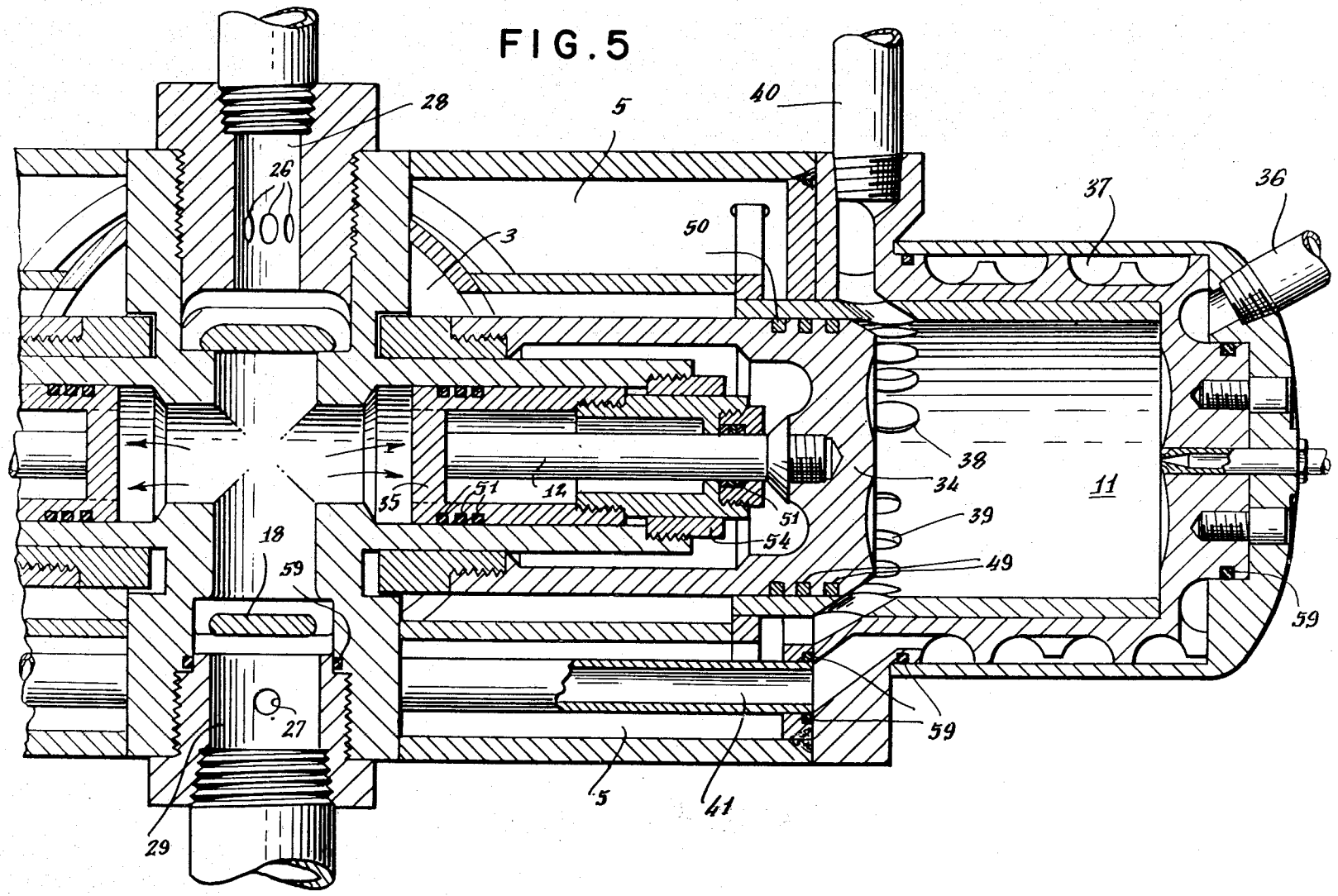
FIG. 5 is a cross-section of the embodiment of this invention shown in FIG. 1 taken along the combustion and fluid flow axes, with the engine at bottom dead center.

FIG. 5 illustrates the same embodiment, also when the combustion pistons of the engine are at bottom dead center, but in this illustration as a partial cross-section along a plane bisecting the combustion and fluid flow mechanism. Illustrated in FIG. 5 are static hydraulic seals 59, compression and oil rings 49, 50, dynamic hydraulic seals 51, the end of a hydraulic line 36 which opens into a toroidal conduit 37 surrounding the combustion chamber 11, combustion cylinder exhaust ports 38, air intake parts 39, and exhaust pipe 40. Combustion piston 34 is shown at bottom dead center where both stages of output pumping pistons 12, 35 are fully extended. The relationship of the two stages is shown and the length of the stroke of the second stage pumping piston 35 can be gauged from the size of the gap (which is vented to the crankcase 3) between the second stage output pumping piston 35 and the second stage output pumping piston retainer nut 54. 27 is an end view of a conduit which supplies low pressure fluid to the output pumping chamber 9 through check valve 2.

Figure 3:
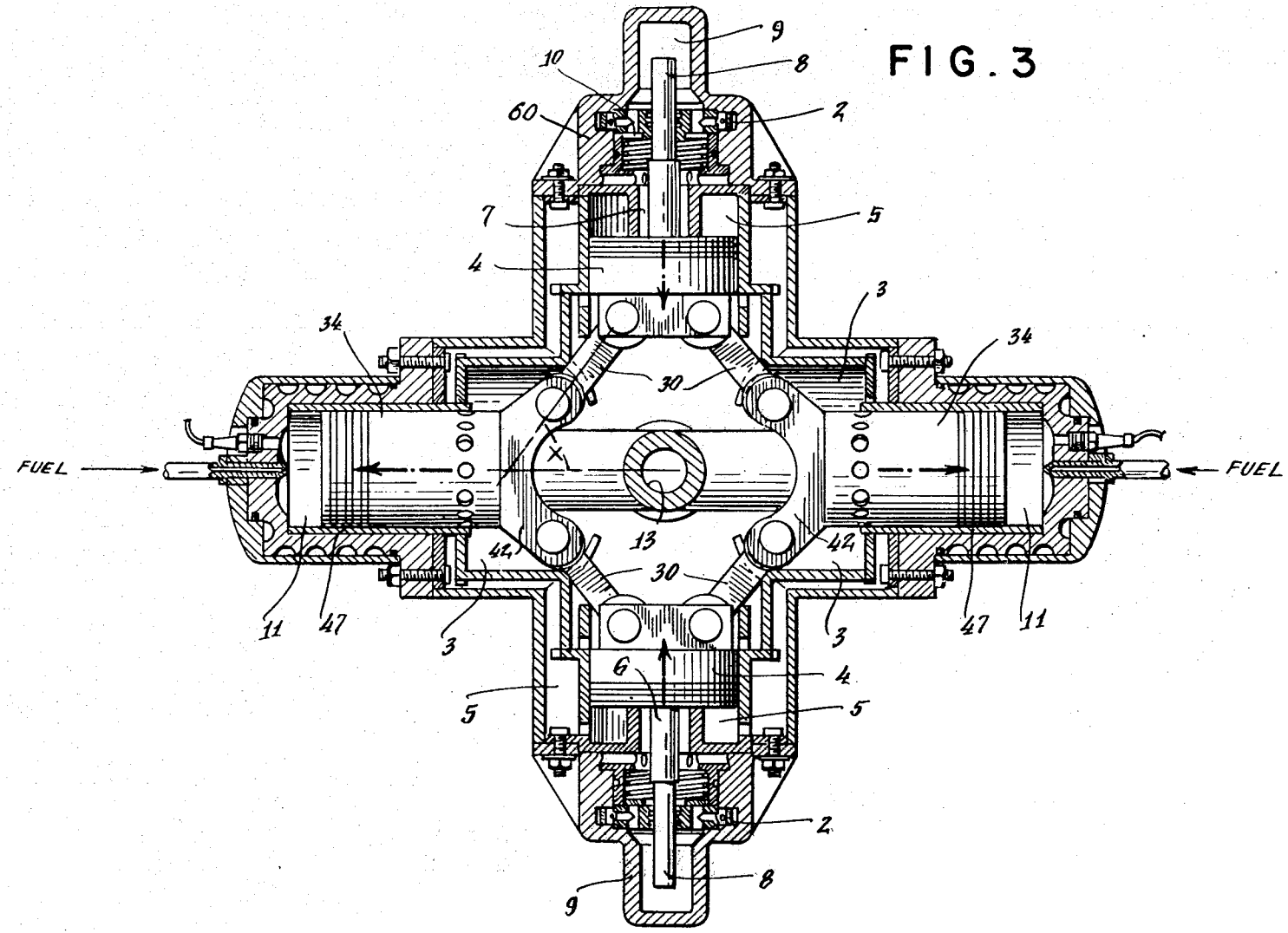
FIG. 3 is a cross-section of the embodiment of this invention shown in FIG. 1 with the engine midway in its compression stroke.

FIG. 3 illustrates the same embodiment, but midway in the compression stroke of the combustion mechanism and as a partial cross-section taken along a plane which bisects the combustion and hydraulic pumping mechanisms. Comparing this FIG. 3 to FIG. 2, it will be apparent that, the combustion pistons 34 having moved away from each other, the connecting rods 30 have caused the pistons 4 to begin to come toward each other. It can be readily seen from the geometry of linkage and relationship between the components in FIG. 3 that given a constant pressure within the compression function chambers 7 that act on compression function piston 6 as the combustion pistons 34 approach top dead center, and keeping in mind that the compression pressure will be greater at that point, the mechanical advantage of the compression function pistons 6 over the combustion pistons 34 has increased to compensate for the greater pressure due to compression in the chamber 11. The force vector of the compression function force along the combustion axis will vary between 0 when the angle X of the connecting rods 30 with the combustion axis is 90 degrees and infinity if that rod angle were to reach 0 degrees.

As can be seen from the geometry of the relative position of the connecting rods the combustion piston axis and the hydraulic pumping pistons axis, the force transmitted to the hydraulic pumping piston through the connecting rod from the combustion piston increases as the tangent of the angle x increases until it reaches 90° during the power stroke. Similarly, on the compression stroke the force transmitted to the combustion pistons through the connecting rods increases as the cotangent of angle x increases as angle x travels between 90% and approaches 0° as the combustion pistons approach top dead center. It is interesting to note that this is analagous to the relationship which exists between combustion pistons and flywheels in conventional engines, but that a major difference is that the method by which compression is accomplished in the present invention does not depend on kinetic energy. Thus it is possible to stop the engine without losing the energy necessary for the next compression stroke. Further, by performing the compression function in this manner it is possible to vary the rate at which compression energy is taken out on the power stroke and the rate at which energy is put in on the compression stroke by varying any one or a combination of the following: the compression function piston surface area; the compression function chamber pressure; the length of the connecting rods; the angular displacement of the connecting rods; the mass of the combustion pistons and the mass of the compression function pistons. It is to be recognized that the same variables can govern the rate at which work is being done on the power stroke as well.

Figure 6:
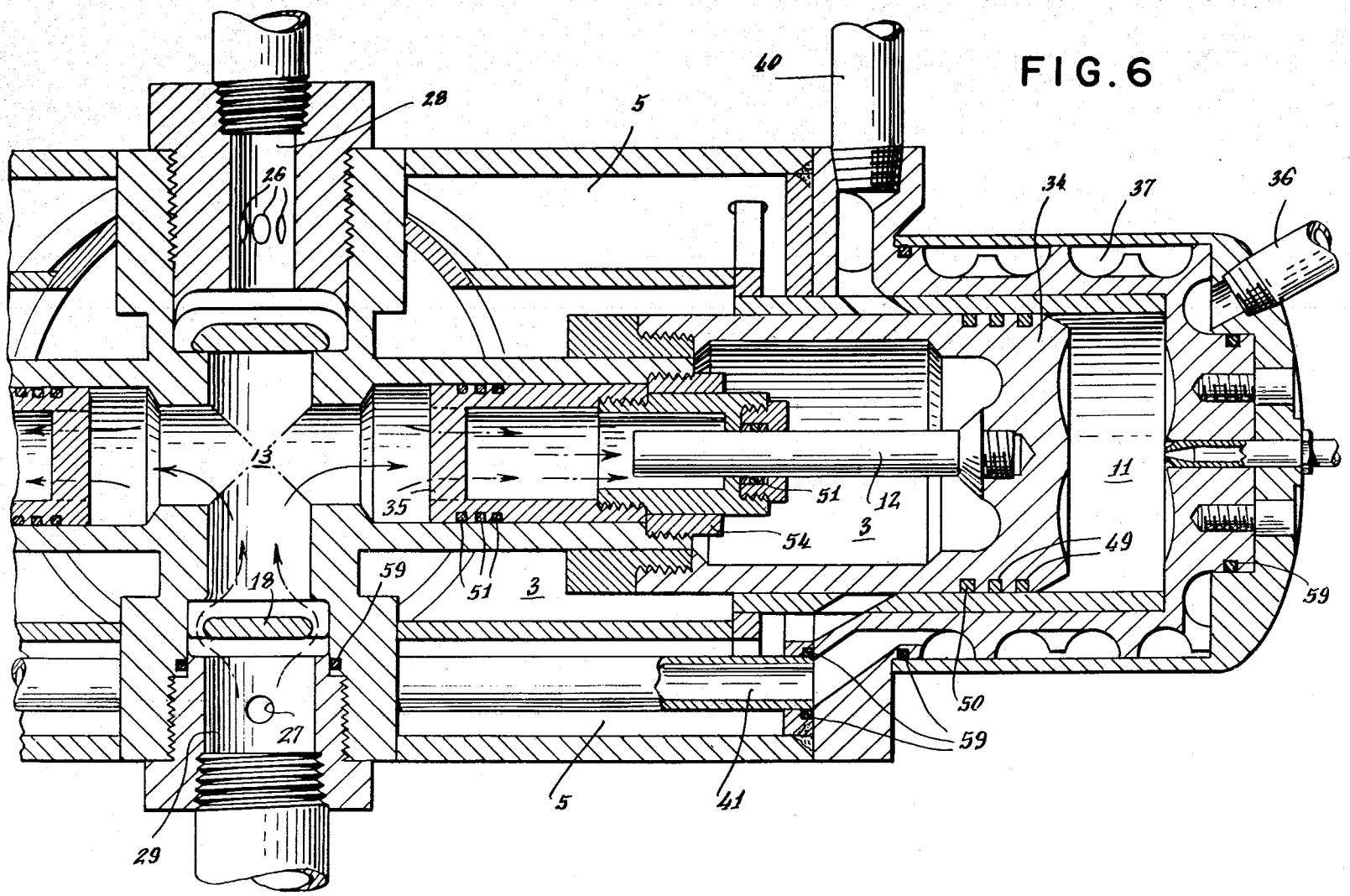
FIG. 6 is a cross-section of the embodiment of this invention shown in FIG. 1 taken along the combustion and fluid flow axes, with the engine midway in the compression stroke.

FIG. 6 is a partial cross-section, also midway in the compression stroke, but along a plane which bisects the combustion and fluid flow apparatus, and thus it is comparable to FIG. 5 except that it represents a different phase in the engine cycle. It should be noted particularly in FIG. 6 that at this phase in the operation, hydraulic oil is flowing through the low pressure line 29, past the open check valve 14, and into the output pumping chamber 13, thus recharging said chamber while the pumping piston 12, and the combustion piston 34, are being impelled upward into the combustion chamber 11, thereby compressing the air residing therein. This effect from the low pressure line may optionally be supplementary to or in lieu of continued thrust supplied by the compression function piston. Check valve 18 is closed because the pressure is output pumping chamber 13 is lower than that in high pressure outlet 28.

Figure 15:
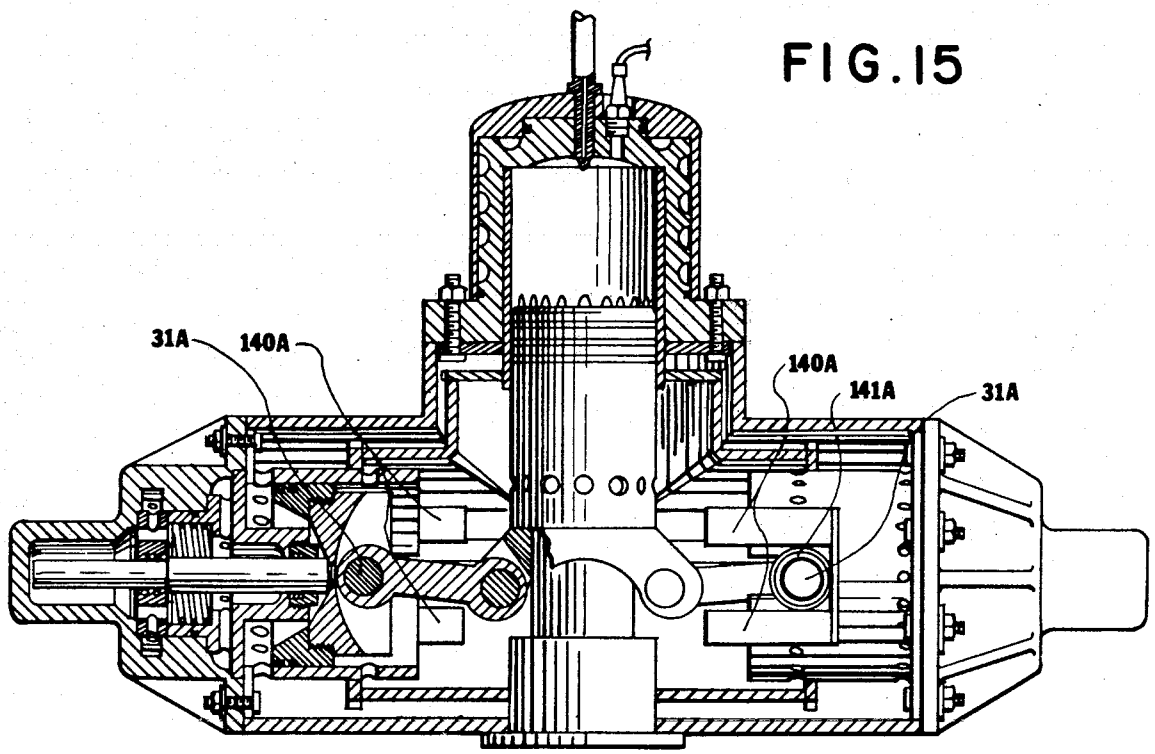
FIGS. 15 through 21 show additional embodiments of this invention which show the versitility of the inventive concepts. Schematics similar to FIGS. 7 through 10 as well as energies and velocity curves as in FIGS. 11 to 14 can be made for these embodiments by one skilled in the art by applying the teachings of this invention.

FIG. 15 illustrates a cross-section of a single combustion piston embodiment of this invention where the eccentric forces caused by the single combustion piston on the two pumping pistons are compensated by cam followers 141A mounted on wrist pins 31A, said cam followers riding along rails 140A which convert the lateral eccentric load on the pumping pistons to an axial driving force along the pumping piston axis.

Figure 16:
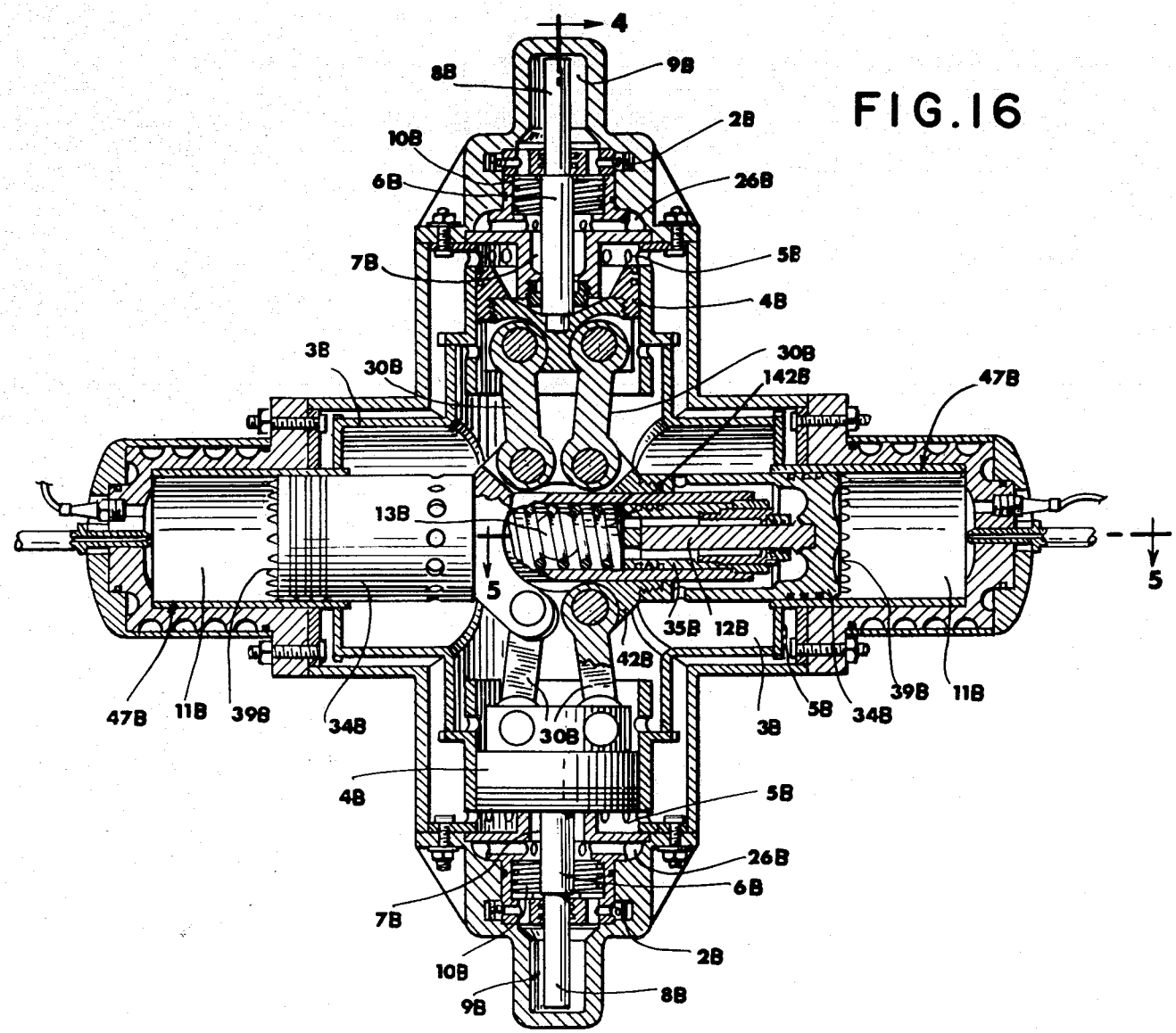

FIG. 16 illustrates a cross-section of the embodiment shown in FIG. 2 with the addition of a spring 142B, located in output pumping chamber 13B for the purpose of absorbing any excess energy at the end of the power stroke, and against which the output pumping pistons 35B rest when the engine is shut off. It can be easily appreciated that other suitable means can be substituted for said spring in order to accomplish the same purpose, such as rubber, mechanical, pneumatic or hydraulic devices.

Figure 17:
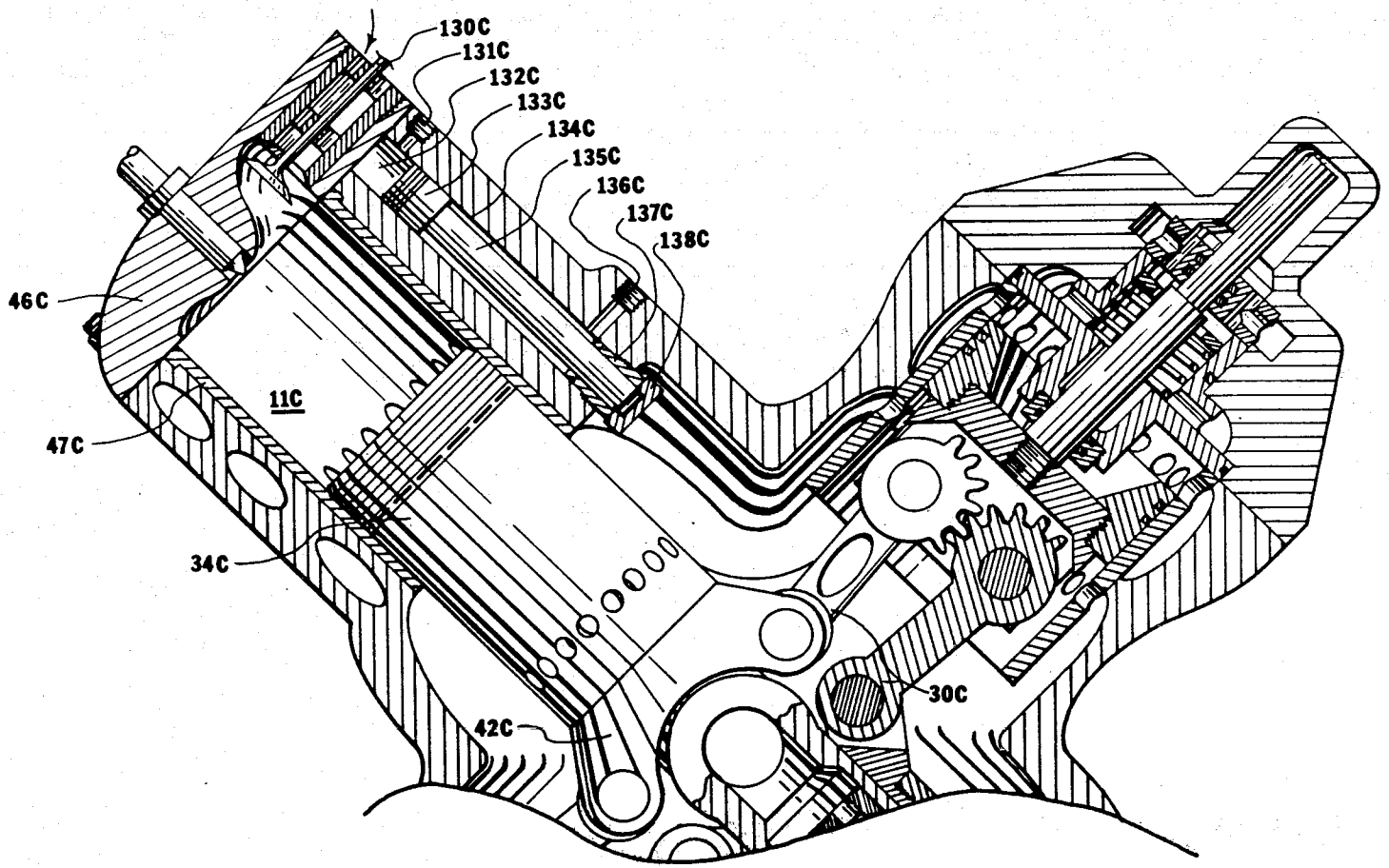

FIG. 17 illustrates a partial cross-section of a modification of the embodiment shown in FIG. 1, this modification showing uni-flow scavenging made possible by the location of an intake valve 130C in the combustion cylinder head 46C. Hydraulic piston 133C attached to piston rod 135C having end cap 138C anticipates a condition where the engine has misfired on the compression stroke, and provides a means whereby the combustion pistons 34C are recycled to bottom-dead-center. This is to be accomplished by the inclusion of a sensor, either hydraulic, mechanical or electrical which is triggered when the combustion pistons 34C travel past a predetermined outer limit on the compression stroke, indicating a misfire. The sensor then opens a valve allowing fluid under high pressure to pass through opening 136C through the recycling control valve and back to a low pressure reservoir. As this piston is extended, the end cap 138C makes contact with connecting rod 30C pushing it to the bottom-dead-center position. At the completion of this stroke the piston assembly is returned to its normal retracted position by a reversal of the recycling control valve causing fluid under high pressure to flow through opening 136C into chamber 134C thus exerting pressure on the bottom side of the hydraulic piston head at the same time that fluid in chamber 132C is being dumped back to low pressure. In order to insure that the combustion pistons 34C are synchronized at and around the ninty degree position of connecting rods 30C, the pumping piston ends of connecting rods 30 are provided with interlocking gear teeth insuring that the force exerted on the one combustion piston 34C by the recycling piston assembly 132C, 135C, 138C is uniformly transferred to the other combustion piston 34C.

Figure 18:
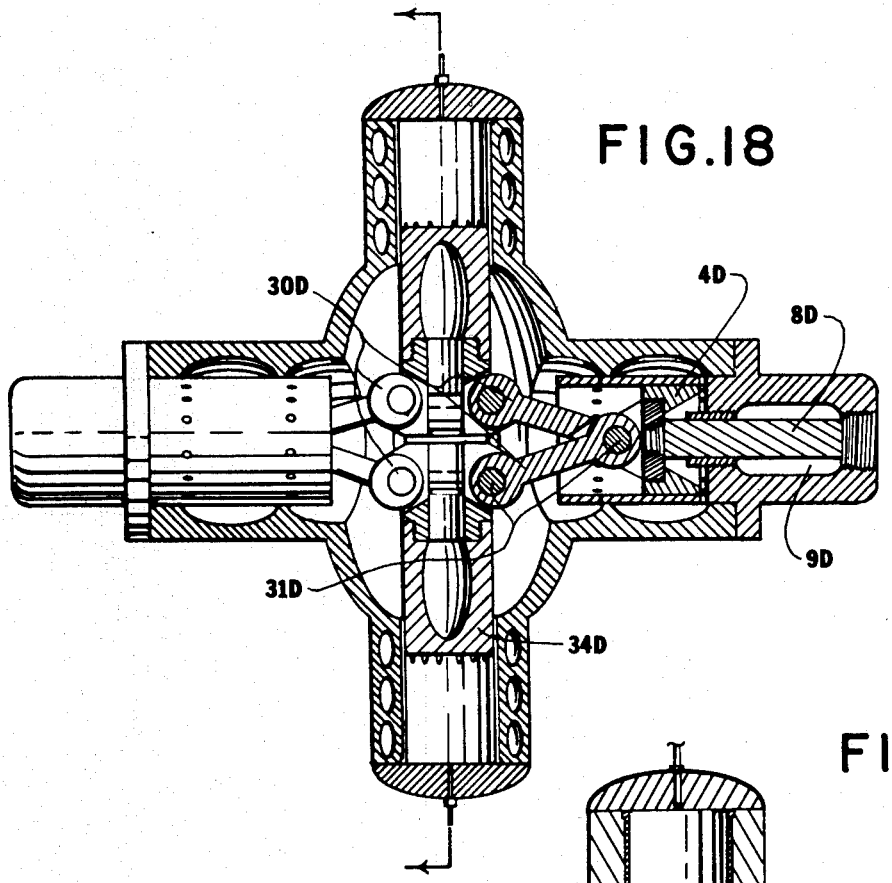
Figure 19:
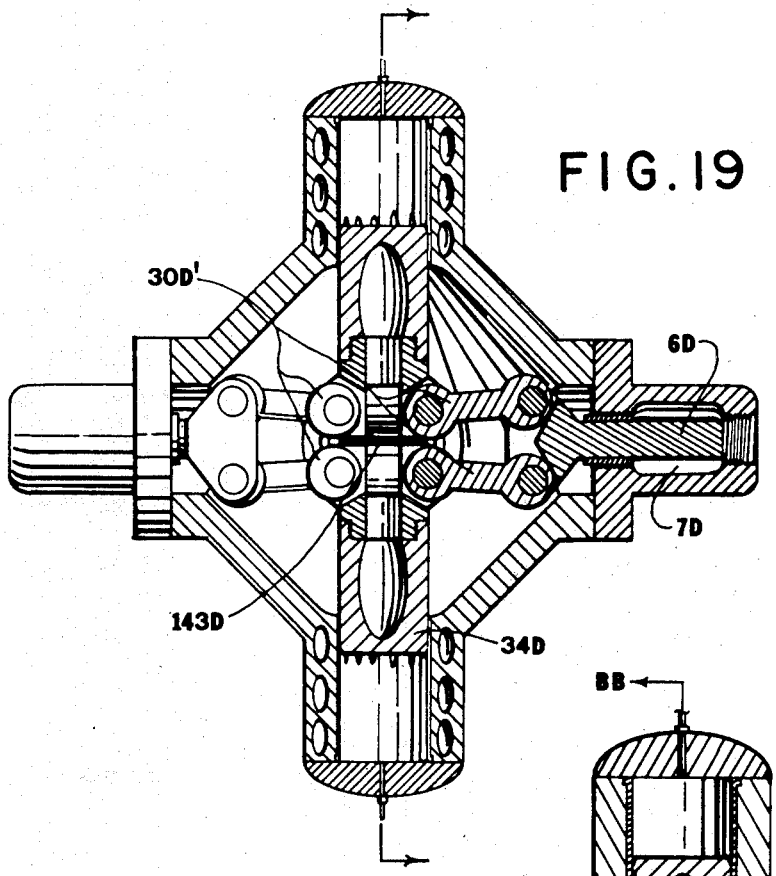

FIG. 18 illustrates a cross-section of this invention where there are no pumping chambers immediately behind the combustion pistons, and all of the output is pumped by the two output pumping pistons 8D whose common axis bisects the combustion piston axis at 90 degrees. Scavenging air compression pistons 4D are attached to the output pumping pistons 8D, and work in conjunction with said output pumping pistons, which are connected to the combustion pistons by connecting rods 30D, the angular displacement of said rods is such that the axis of the rods drawn between the points at the center of rotation of the wrist pins 31D never reaches 90 degrees with the combustion piston axis as said combustion pistons approach bottom dead center, hence any pressure in output pumping chamber 9D is transmitted through the output pumping pistons to their respective connecting rods thence resulting in a positive force in the direction of the compression of the combustion pistons. FIG. 19 illustrates a cross-section of the embodiment shown in FIG. 18 and is taken through the combustion piston and the compression function piston axis, thus showing a second pair of hydraulic pistons for the purpose of performing the compression function. The compression function pistons 6D are connected to the combustion pistons 34D by two additional pairs of connecting rods 30D[1], the axis of said rods having an angular displacement such that they go beyond a 90 degree angle with the combustion piston axis as the combustion pistons approach bottom dead center, thus any pressure in compression function chamber 7D is transmitted through the compression function pistons to their respective connecting rods then serving to hold the combustion pistons at bottom dead center when they have gone beyond said 90 degree angles during the power stroke of said combustion pistons. In this range of the strokes, the end of the power stroke and the beginning of the compression stroke, a pressure in the compression function chambers 7D results in a negative force in the direction of the compression stroke. Because of the relative angular displacements of the compression function connecting rods 30D[1], and the output function connecting rods, 30D and the relative size and pressures in the compression function chambers 7D and the output pumping chambers, 9D and of their respective pistons the net resultant force for compression is positive any time that there is pressure in the output pumping chambers 9D, hence, in this embodiment the engine is started by allowing system pressure into the output pumping chamber 9D in the same way that is provided for in the embodiment shown in FIGS. 7–10, and the engine is stopped by shutting off the pressure to said chamber at the bottom of the power stroke. At that point the compression function pistons 6D which are always exposed to system pressure, lock the engine in the bottom dead center position shown. Shock absorbant disks 143D are shown against which the combustion pistons 34D rest when the engine is in the bottom dead center position.

Figure 20:
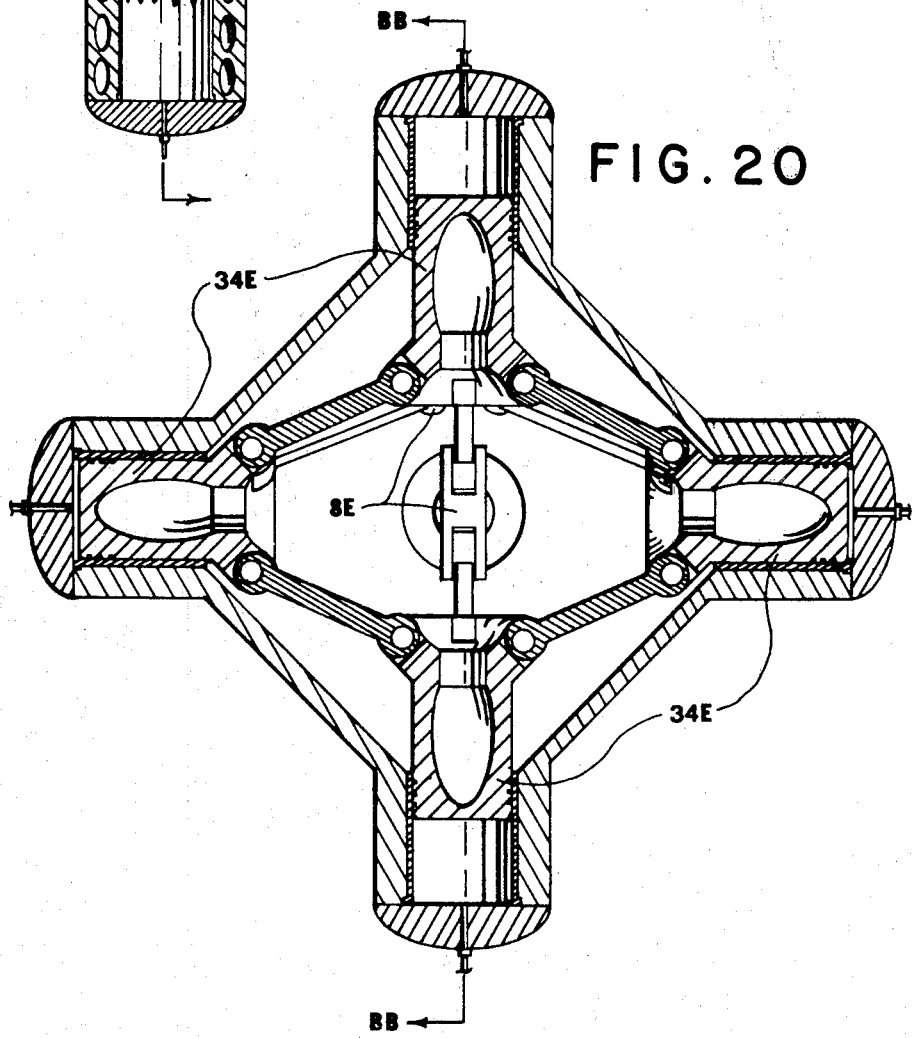

FIG. 20 illustrates still another embodiment of the invention which has four combustion pistons 34E and four pumping pistons 8E. These pumping pistons 8E are arranged in pairs, the two pistons in each pair having a common axis. Likewise with the combustion pistons, the two combustion pistons in each pair share a common axis. The axis of the combustion pistons are at ninty degrees to one another, while the axis of the pumping pistons are at forty five degrees to one another. One pair of pumping pistons is attached to each pair of combustion pistons in such a way that the pumping stroke of the pair of pumping pistons takes place during the power stroke of the combustion pistons to which they are attached. The combustion pistons are attached in such a way that the power stroke of one pair of combustion pistons takes place during, and drives the compression stroke of the other pair of combustion pistons. In this embodiment there is no locking feature as described and illustrated in FIG. 8, rather the engine is controlled and cycled for starting by the use of valves across the major outputs. Once the engine is started the passage of the fluid in and out of the pumping chambers 9E is controlled by check valves. This embodiment would lend itself to a continuous output application where pumping on every stroke was required, and the engine was seldom shut down.

Figure 21:
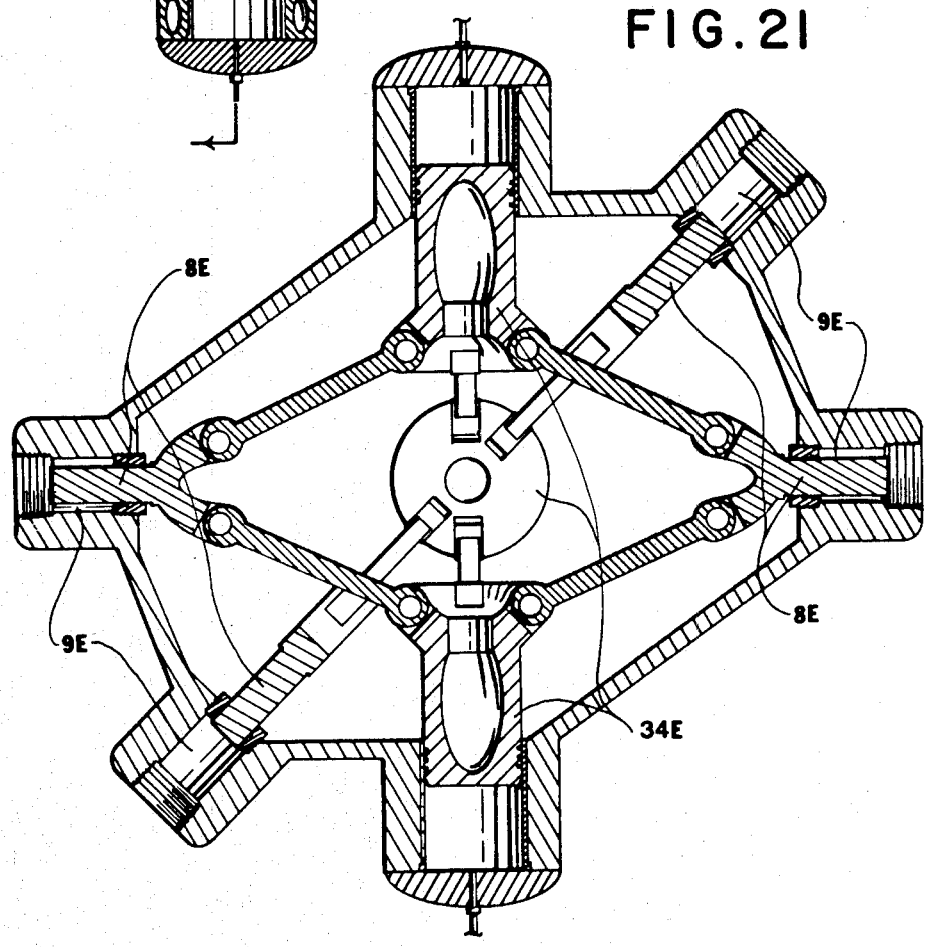

FIG. 21 illustrates another cross-section of the embodiment shown in FIG. 20. This cross-section is taken along BB, and shows with greater clarity the relationship between pumping pistons 8E and their relationship with the combustion pistons 34E.

FIGS. 7 through 10 illustrate a schematic representation of apparatus useful in connection with the operation of embodiments of this invention, and particularly of the embodiment of this invention illustrated in FIGS. 1 through 6. Using American National Standard symbols, there is depicted an engine embodying the present invention outlined generally by the dashed lines. Illustrated in FIGS. 7 through 10 are the following components, the designations for which correspond to those shown in FIGS. 1 through 6 inclusive; a crankcase reed valve 1 and a second stage scavenging air chamber reed valve 1A, both of which are located at the engine housing 57, check valves 2, a crank case cavity 3, scavenging air compression pistons 4, second stage scavenging air compression chambers 5, compression function pistons 6, compression function chambers 7, pumping chambers 9, check valves 10, combustion chambers 11, pumping pistons 12, pumping piston chamber 13, check valve 14, a start-stop control valve 15, a compression control valve 16, a check valve 17, a check valve 18, a high pressure hydraulic fluid accumulator 19, a hydraulic motor 20, a low pressure hydraulic fluid holding tank 21, a filter 23, a check valve 24, a high pressure relief valve 25, channels 26, hydraulic fluid supply line 27, high pressure hydraulic fluid line 28, low pressure hydraulic fluid line 29, fuel injectors 33, combustion pistons 34, exhaust pipes 40, a fuel pump 66, fuel line check valves 67, a filter 68, a fuel tank 69, a hydraulic fluid cooler 71, a muffler 70, and a fuel injector control valve 72.

The exhaust system is shown as exhaust outlets 40 leading to the muffler system 70.

The fuel injection system is shown as injectors 33, variable displacement hydraulic intensifier fuel injection pump 66, fuel line check valves 67, fuel filter 68 and tank 69. This system is operated by fuel injection valve 72 which is mechanically piloted in response to the motion of the stepped pumping pistons 4, 6, 8. This valve 72 may be made variable as to timing.

The stepped pumping pistons 4, 6, 8 are shown as scavenging air compression pistons 4, compression function pistons 6 and output pumping pistons 8. The compression function circuit includes the high pressure reservoir 19, the high pressure outlet 28, conduits 26, compression function chambers 7 and compression function pistons 6.

During the power stroke of combustion pistons 34 which is more fully described hereinafter, the stepped pistons 4, 6, 8 move so that hydraulic pumping pistons 8 displace fluid under high pressure from output pumping chambers 9. Compression function pistons 6 are sized so that for a given system pressure they store sufficient energy to perform the compression stroke hereinafter described, that has been stored under high pressure during the power stroke. Compression function chambers 7 are always open to high pressure through channels 26, even when the engine is stopped. It is to be recognized however, that all or part of the output pumping may be accomplished by the compression function pistons 6 by adding to their surface area sufficiently to achieve output pumping, and then performing the compression stroke with fluid from a lower pressure reservoir. Thus it is possible to eliminate either the output pumping pistons 12 and their chamber 13 or the output pumping pistons 8 and their chambers 9, or all of them.

Figure 7:
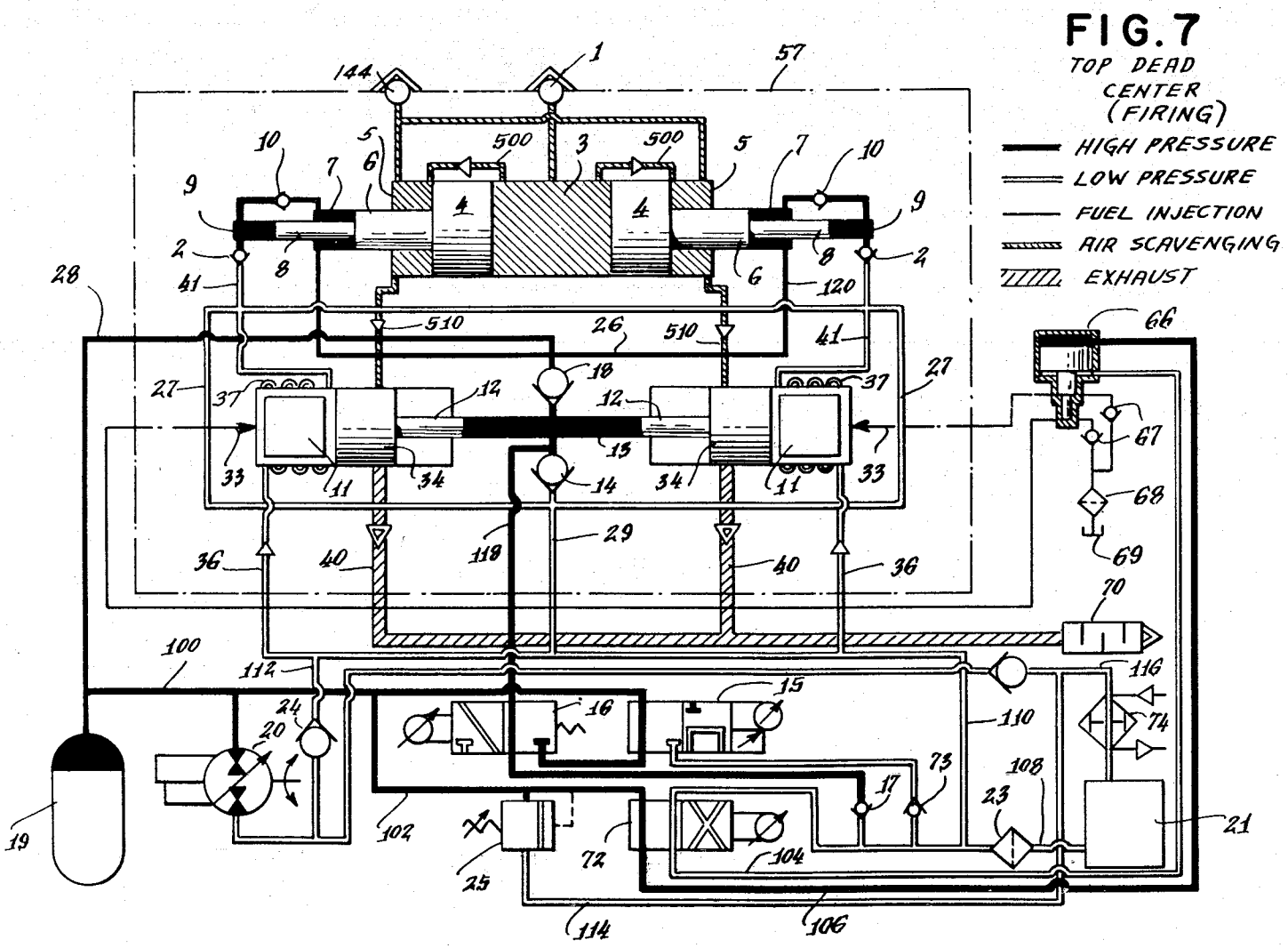
FIG. 7 is a schematic representation of a typical hydraulic circuit useful in connection with the embodiment of this invention shown in FIG. 1.

It will be noted that combustion elements of this embodiment form a two cycle engine. Thus, referring to FIG. 5 in particular, it will be seen that in the lower end of the wall of the combustion cylinder 11 there are exhaust ports 38 which connect to the exhaust pipe 40, and air intake ports 39, which are a little lower than the exhaust ports 38. Thus, at the end of the firing stroke, the top of the pistons 34 will have passed the exhaust ports 38 to permit exhaust to enter the exhaust pipe 40, after which the piston head will have moved downward sufficiently for air to be injected into the cylinder 11 via the air inlet ports 39 in preparation for the compression stroke. This injection of air is achieved by the scavenging air system by which air sucked into the crankcase 3 of the engine through the crankcase reed valve 1 by the movement of the scavenging air compression pistons 4 away from each other during the firing phase as shown in FIG. 7, and is then forced through line 500 when the scavenging air compression pistons 4 move toward each other during the compression phase shown in FIG. 10, and into the second stage scavenging air compression chamber 5. While the air is being compressed in the crankcase 3, still more air is being drawn into the chamber 5 through the reed valve 144. On the next firing stroke, again as shown in FIG. 7, the movement of the air scavenging pistons 4 back into the second stage scavenging air compression chamber 5 forces this air through the air scavenging lines 510 so that charges of air under pressure will be waiting in the lines 510 when the combustion pistons 34 pass the air inlet ports 39, thereby permitting air to be injected into the chambers 11 in preparation for the next compression stroke. By placing the intake port in the head it is possible to supercharge the engine by this method. A drawback of prior art devices is that in them air is either scavenged by the use of dynamic compressors which are inconvenient to the intermittent operation of the engine, or by a variation on conventional crankcase scavenging where the quantity of air available is less than the displacement of the engine, thus there is no supercharging. The present invention makes possible positive pressure scavenging (supercharging) in a manner which is organic to the intermittent operation of a hydraulic engine.

The output pumping circuit is shown as output pumping chambers 9, 13, output pumping pistons 8, 12, check valves 10, 18 through which fluid flows under high pressure from output pumping chambers 9, 13 and through conduits 26, 28 respectively to the high pressure reservoir 19. During the compression stroke, low pressure fluid flows into output pumping chambers 9, 13 from low pressure reservoir 21, through the filter 23, conduits 29, 36, 37, 27, 41 and check valves 14, 2 respectively.

On the compression stroke of combustion pistons 34, fluid is drawn in from a low pressure reservoir 21 through check valves 2 into output pump chambers 9 and through check valve 14 into output pumping chamber 13. On the power stroke of combustion pistons 34, fluid is pumped through check valves 10 from output pumping chambers 9 into compression function chambers 7, thence through channel 26 to a high pressure reservoir 19, and from output pumping chamber 13 through a check valve 18 to a high pressure reservoir 19.

The hydraulic transmission is shown as a pressure compensated variable displacement hydraulic motor 20, serviced by high pressure reservoir 19. Fluid flows therefrom when the hydraulic motor 20 is driven by the system, or thereto when the motor 20 is acting as a pump, absorbing excessive kinetic energy on its shaft; i.e., during "regenerative braking". When the hydraulic motor 20 is being driven by the kinetic energy, that is during regenerative braking, hydraulic fluid in the low pressure holding rank 21 may pass through line 108 and filter 23 into line 110, and thence into line 112, and through check valve 24, where it will be available to be pumped by the motor 20, now acting as a pump and therefore having a braking effect on the vehicle, into the high pressure accumulator 19.

There is also shown a high pressure relief system, which may also be operated at any time when the hydraulic fluid in the high pressure lines exceeds desired limits. In this portion of the system, oil in the line 100 passes into the line 102, and then through a high pressure relief valve 25 which, advantageously, may be activated by a pressure responsive mechanism of known per se design, from whence the hydraulic fluid is free to pass through the line 114, into the holding tank return line 116, through the heat exchanger 74, and into the low pressure holding tank 21.

The compression control valve 16 and the stop-start valve 15 function in the following manner. The compression control valve 16 is mechanically operated, responding to the motion of the combustion pistons 34 as they reach the point where the connecting rods 30 make an angle of 90 degrees with the combustion axis. The compression control valve is adjustable within that range. It can be seen by the geometry of the pistons and connecting rods 30 as shown in FIGS. 2 and 3 that at the end of the power stroke, when combustion pistons 34 have come to a halt and, for example if the system is sufficiently pressurized to accommodate the work load of the motor 20, there is no reason for the combustion pistons 34 to proceed into the compression stroke since the vector of the forces exerted by the compression function pistons 6 through the connecting rods 30 along the combustion axis is negative, i.e., away from top dead center, and the engine will be locked at bottom dead center. The compression control valve 16 prevents this from happening. On the bottom dead center side of the locked position, that is, when the conencting rods 30 are beyond the 90 degree point, the compression control valve 16 connects output pumping chamber 13 with high pressure reservoir 19 through stop-start valve 15, and, as hereinafter described, this causes the combustion pistons 34 to move back through the dead center position to commence the compression phase. At all other positions of combustion pistons 34, on both the power and the compression stroke, the compression control valve 16 connects output pumping chamber 13 with check valve 17 through which fluid flows from the low pressure reservoir 21 through filter 23.

The stop-start valve 15 may be controlled manually and or in response to changes in system pressure as follows. At some desired high pressure it connects compression control valve 16 with the low pressure reservoir 21 through check valve 73. Thus when the engine reaches bottom dead center, output pumping chamber 13 is connected to the low pressure reservoir 21, rather than to the high pressure which is necessary for the start of the compression stroke. At some desired lower pressure, the stop-start valve 15 connects compression control valve 16 with the high pressure reservoir 19, thus output pumping chamber 13 sees high pressure which forces combustion piston 34 to the other side of the lock past which the compression function pistons 6 can complete the rest of the compression stroke, thus restarting the engine. The stop-start valve 15 remains in this position until some desired high pressure is again reached and the engine stops. It is recognized that there might be circumstances or applications where it is desirable to start or stop the engine manually, thus the stop-start valve 15 may be dual controlled.

Figure 8:
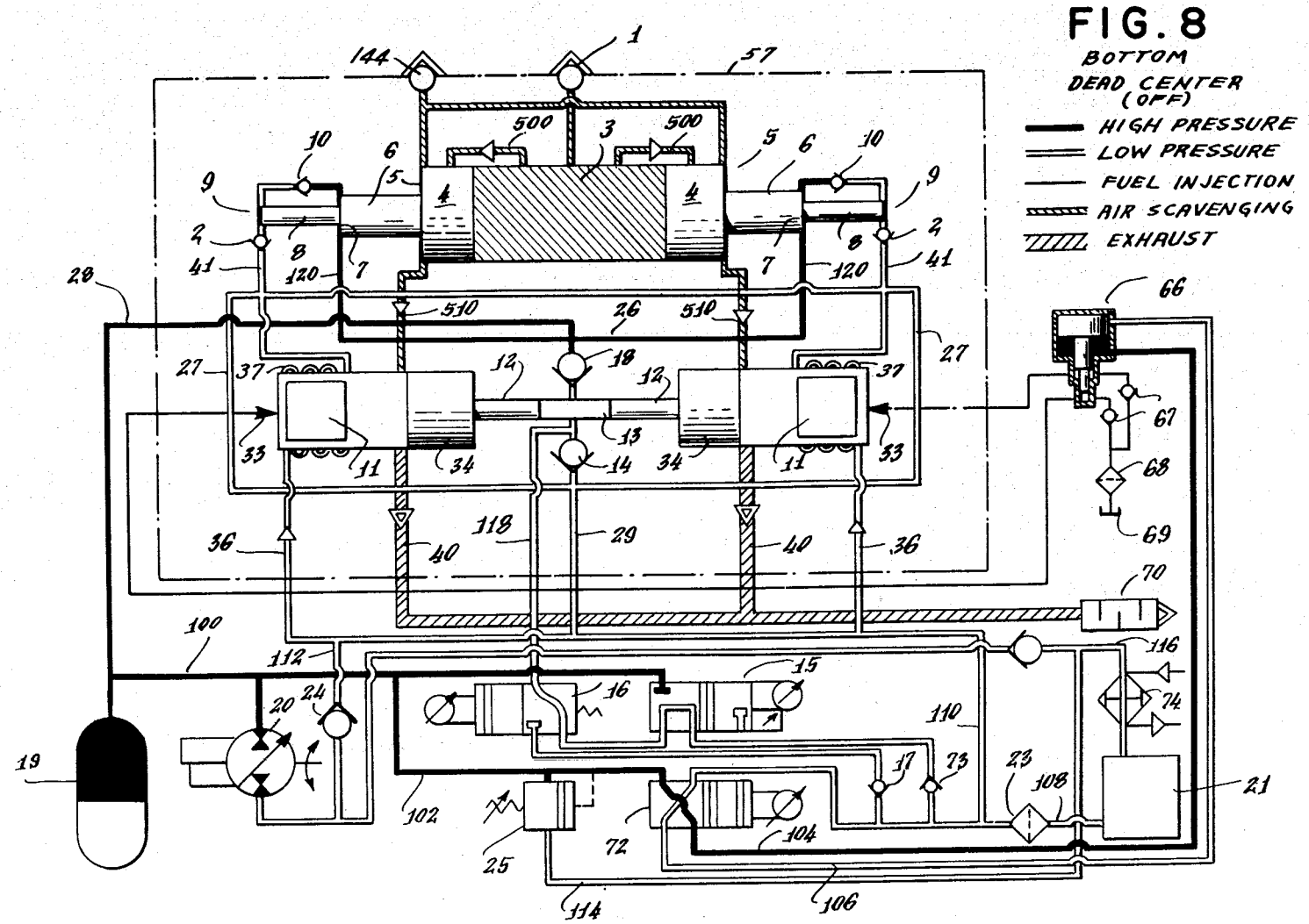
FIG. 8 is a schematic representation of a typical hydraulic circuit useful in connection with the embodiment of this invention shown in FIG. 1.

FIG. 8 illustrates the conditions of the apparatus control systems when the combustion pistons are at the bottom dead-center position, i.e., comparable to the conditions illustrated in FIGS. 2, 4, and 5, with the engine off. The combustion pistons 34 are at their closest position to each other, and they are held there since, as shown in FIG. 2, while resting in this position the connecting rods 30 from each piston 4 converge toward each other where they connect with the piston rod yokes 42 at the base of each of the combustion pistons 34, since, as shown in FIG. 8, high pressure hydraulic fluid in the accumulator 19, maintains pressure in hydraulic fluid line 28 which, in turn, energizes line 26 and applies hydraulic pressure side of the pistons 6, the convergence of the connecting rods 30 hold the combustion pistons 34 in the bottom dead center position.

At that point, hydraulic fluid under high pressure is free to travel through the conduit 100, into conduit 102, through the fuel injection control valve 72, and into the fuel pump high pressure line 104, thereby causing the main piston in the fuel pump 66 to actuate. By further activation of the fuel pump control valve 72 according to known per se techniques, the line 104 may be depressurized, and simultaneously pressurizing the line 106 and the opposite side of the piston in the fuel pump 66 causes the piston to move in the opposite direction, thereby causing it to pump fuel. It should also be noted that hydraulic oil is free to move from the low pressure holding tank 21 through the low pressure main line 108 and filter 23 through line 110, fluid heating lines 36 with their toroidal sections 37 around the combustion chambers 11 which impart heat to the oil and lower its viscosity and therefor its friction, into the conduit 41, past the check valves 2, and into the pumping chambers 9, where, through inter-action on the pumping pistons 8, the scavenging air pistons 4 exert further pressure to lock the combustion pistons 34 into the bottom dead center position through the action of the connecting rods 30.

Figure 9:
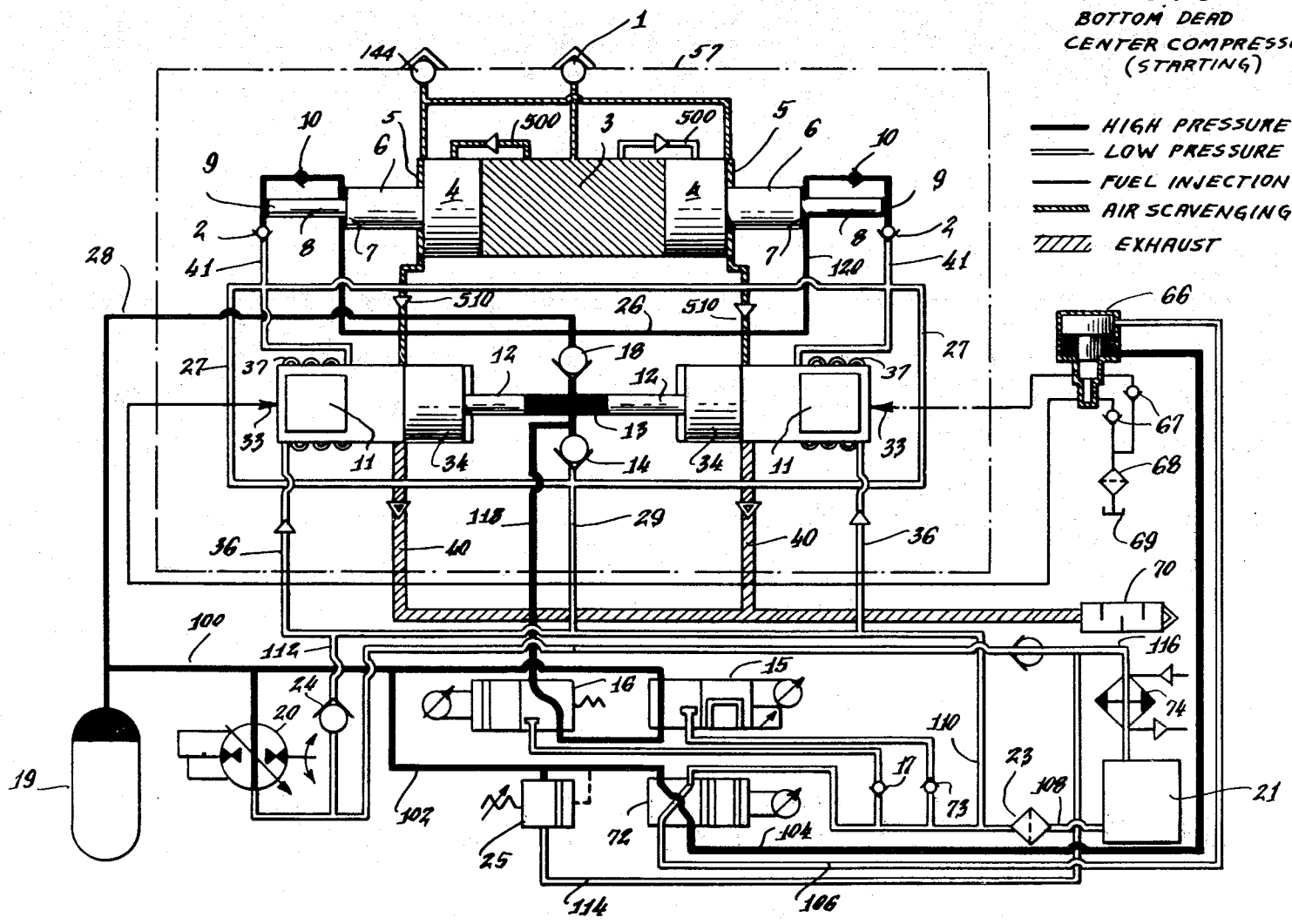
FIG. 9 is a schematic representation of a typical hydraulic circuit useful in connection with the embodiment of this invention shown in FIG. 1.

Turning next to FIG. 9, there is depicted the system shown in FIG. 8, with the engine still in bottom dead center position, but starting for the purpose of initiating the compression phase. The principle change in situation is that the stop-start control valve 15, in response either to an automatic monitoring apparatus such as a pressure switch or to manual operation of a switch, has been activated, permitting hydraulic fluid under high pressure in line 100 to pass through compression control valve 16, and to enter the line 118, thereby to enter the pumping piston chamber 13. Referring also to FIGS. 2 and 6, it will be apparent that the effect of this is to cause the piston 12 to move the combustion piston 34 upward, eliminating the locking effect of the connecting rods 30 as their pinioned ends pass through the dead enter position and commencing the compression of the air which resides in the combustion cylinder 11. Of course, a corresponding series of actions occurs with respect to the other combustion piston 34 as well, so that the net effect is that the pair of combustion pistons 34 move away from each other as they compress the air in the chambers 11 associated with them respectively, while the air scavenging pistons 4 correspondingly move toward each other.

This phase of operation assumes there is sufficient pressure available to effect the aforesaid starting sequence. Since there might not be sufficient pressure available for this purpose under certain forseeable circumstances, (e.g., when the engine has been shut off for a substantial period of time), supplementary means may be provided for producing such pressure, such as an electric storage battery connected to a small auxiliary pump (neither of which are shown) connected into the line 100.

Figure 10:
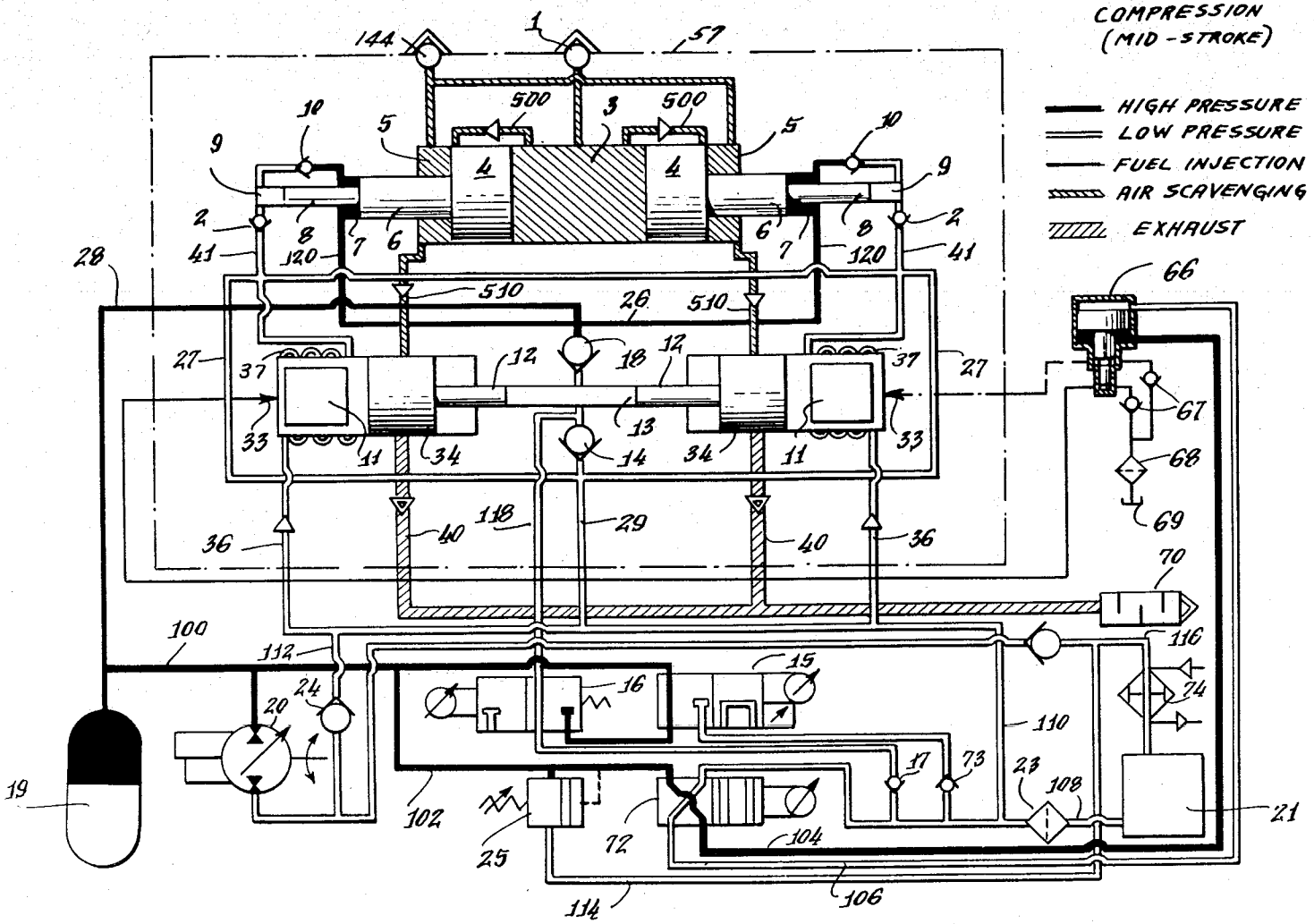
FIG. 10 is a schematic representation of a typical hydraulic circuit useful in connection with the embodiment of this invention shown in FIG. 1.

Once the piston 12 has been activated and the pistons 34 have moved sufficiently away from each other, low pressure hydraulic fluid is free to flow from the low pressure holding tank 21 through the filter 23 and line 110, into line 29, and past the check valve 14 into the pumping chamber 13. FIG. 10 illustrates this condition as does FIG. 6, and FIG. 3 which illustrates the same phase of operation but is taken along a plane which bisects the combustion and hydraulic pump constituents of the apparatus. It will be noted from FIGS. 9 and 10 that compression during the compression stage is effected by the high pressure effect of hydraulic fluid acting backward through the primary high pressure fluid lines 120. This has the effect of forcing the hydraulic cylinders towards each other and this, in turn, through interaction of the connecting rods 30, completes the motion of the combustion pistons as they proceed through the compression phase.

FIG. 7 illustrates the condition of the system at the moment of firing. The compression function chambers 7 and the pumping piston chamber 13 are interconnected hydraulically by check valve 18 and the combustion pistons 34, are mechanically connected to the stepped pistons 4, 6, and 8 by the connecting rods 30, so that on the combustion of the fuel-air mixture residing in the combustion chambers 11, hydraulic fluid is pumped under high pressure into the system via the lines 120 and 28 and into the accumulator 19. This becomes a primary source of power for operation of the hydraulic motor 20 which may be appropriately interconnected with the machinery to be powered by known per se power transmission means. Upon completion of the firing stroke illustrated in FIG. 7, the combustion pistons 34 will again be at the bottom dead center position, and the situation in the engine and in the associated hydraulic system, upon actuation of the compression control valve 16 and consequent high pressure energization of the pumping piston chamber 13, will be substantially as shown in FIG. 9.

FIGS. 11 through 14 are energy and velocity curves for an embodiment of the present invention like those hereinbefore discussed. In each of these figures, two sets of curves are illustrated; one for a system operating at 2500 lbs. per sq. in. and one at 3000 lbs. per sq. in. They are based on the following premises:

Combustion piston weight=12 lbs.
Hydraulic piston weight=12 lbs.
Connecting rod weight=3 lbs. each Drawings Designation #

Figure 11:
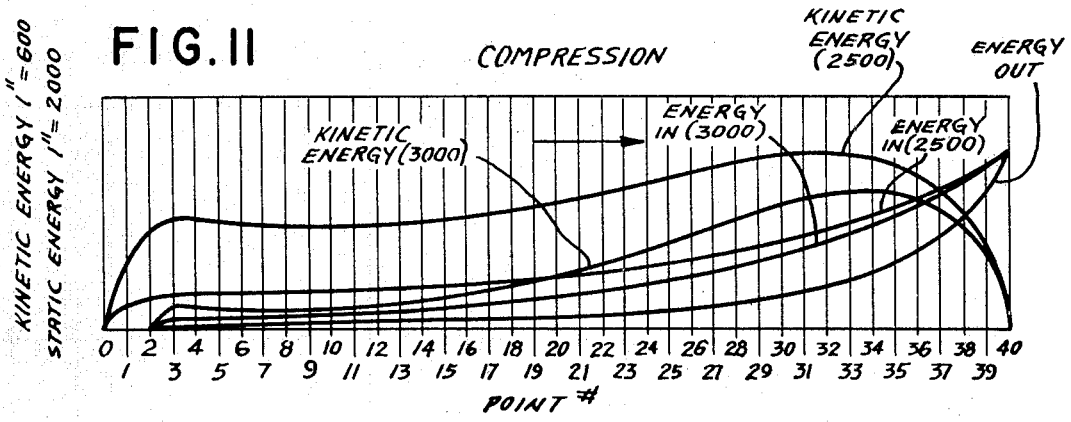
FIG. 11 shows a graphic representation of the energies which may be involved in the compression stroke of an embodiment of the present invention such as shown in FIG. 1.

11 Combustion Cylinder Bore=4 inches
34 Combustion piston Stroke=4 inches
6 Compression Function piston surface area=0.286 sq. in.
8 Pumping piston surface area=0.379 sq. in.
8 Pumping piston Diameter=0.695 inches
4, 6, and 8 Piston Stroke=2.87 inches
12 Hydraulic Piston area=0.333 sq. in.
12 Piston Diameter=0.651
35 Hydraulic Piston Diameter=2.20 in.
30 Connecting Rod Length (pivot to pivot)=3.8 inches FIG. 11 is a graphic representation of the energies involved in the compression stroke. The curve "ENERGY OUT" represents the rate at which energy is being taken out during the compression stroke. This curve includes frictional resistence. The curve "ENERGY IN (2500)" represents the rate at which energy is put in when system pressure is at 2,500 p.s.i. The curve "ENERGY IN (3000)" represents the rate at which energy is put in when the system pressure is at 3,000 p.s.i. On a larger scale on the energy axis, the curve "KINETIC ENERGY (2500)" represents the difference between the rate at which energy is put in and the rate at which energy is taken out. That difference identifies the kinetic energy at any point with the system at 2,500 p.s.i. The curve "KINETIC ENERGY IN (3000)" represents the difference between the rate at which energy is put in and the rate at which energy is taken out. Again, this difference identifies the kinetic energy of the system when the system is at 3,000 p.s.i.

Figure 12:
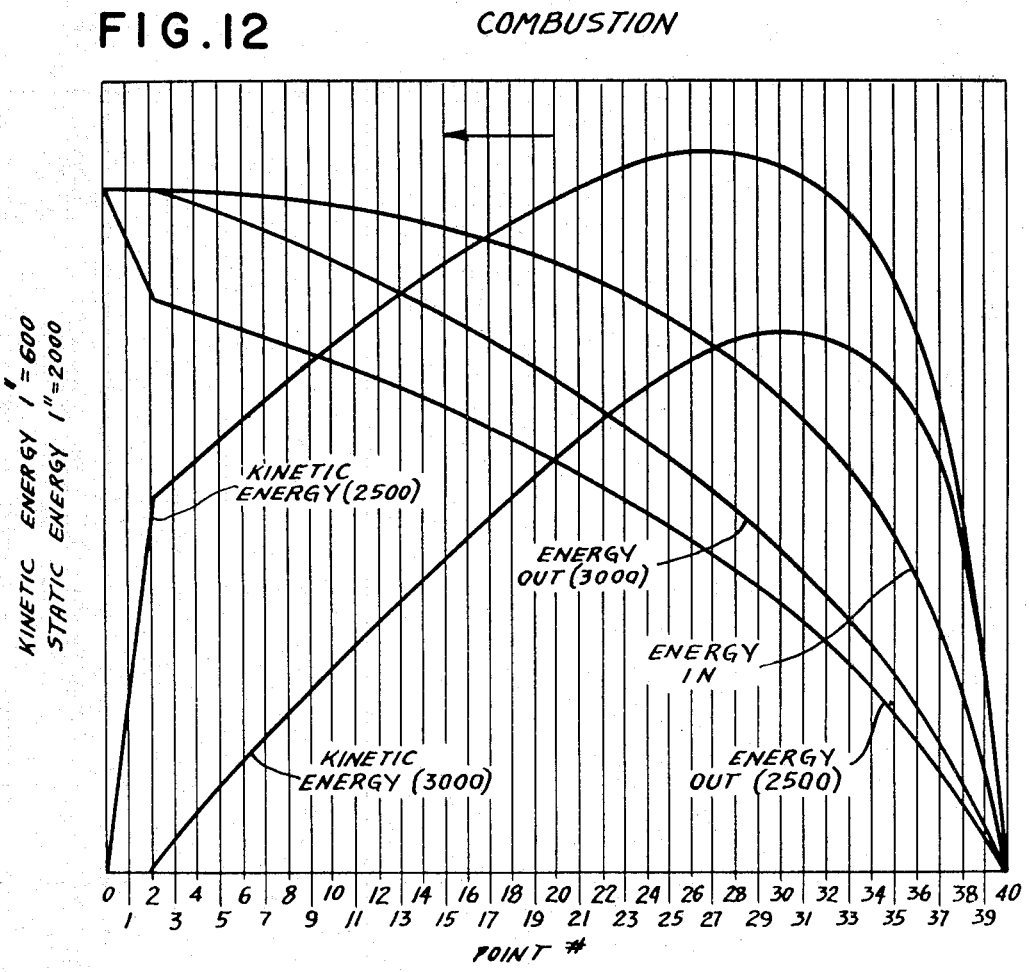
FIG. 12 shows a graphic representation of the energies which may be involved in the compression stroke of an embodiment of the present invention such as shown in FIG. 1.

FIG. 12 is a graphic representation in the energies involved in the power stroke. The curve "ENERGY IN" represents the rate at which combustion energy is put in on the power stroke. The curve "ENERGY OUT (2500)" represents the rate at which energy is being absorbed by the hydraulic system when system pressure is at 2,500 p.s.i. This curve also includes the energy absorbed by friction. The curve "ENERGY OUT (3000)" represents the rate at which energy is being absorbed by both friction and the hydraulic system on the power stroke when system pressure is at 3,000 p.s.i. The curve "KINETIC ENERGY (2500)" represents the difference between the rate at which combustion energy is put in and the rate at which hydraulic and friction energy are taken out when system pressure is at 2,500 p.s.i. This difference is identified as kinetic energy. The curve "KINETIC ENERGY (3000)" represents the difference between the rate at which combustion energy is put in and the rate at which hydraulic and friction energy are taken out when system pressure is at 3,000 p.s.i. again being identifiable as kinetic energy.

Figure 13:
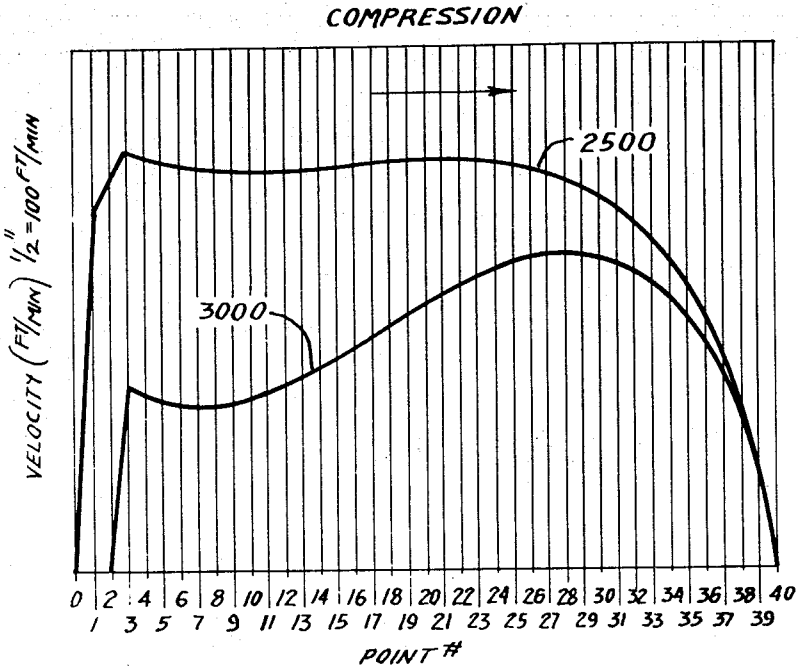
FIG. 13 shows a graphic representation of the velocities which may be involved in the compression stroke of an embodiment of the present invention such as shown in FIG. 1.

FIG. 13 is a graphic representation of the velocities involved in the compression stroke, these velocities being derived from the kinetic energy curves of FIG. 11. The curve "2500" represents the velocity of the combustion piston when the system pressure is 2,500 p.s.i. Likewise the curve "3000" is for a pressure of 3000 p.s.i. These curves reflect the effect on velocity of a combustion piston and a stepped piston and a connecting rod of given mass having the geometry according to the present invention. It can be appreciated that as the system pressure builds between these pressures, the velocity of the combustion piston decreases between the limits of the two curves. It can also be appreciated that the engine can be designed to operate at other pressures, both above and below and within tighter limits than those used in the example.

Figure 14:
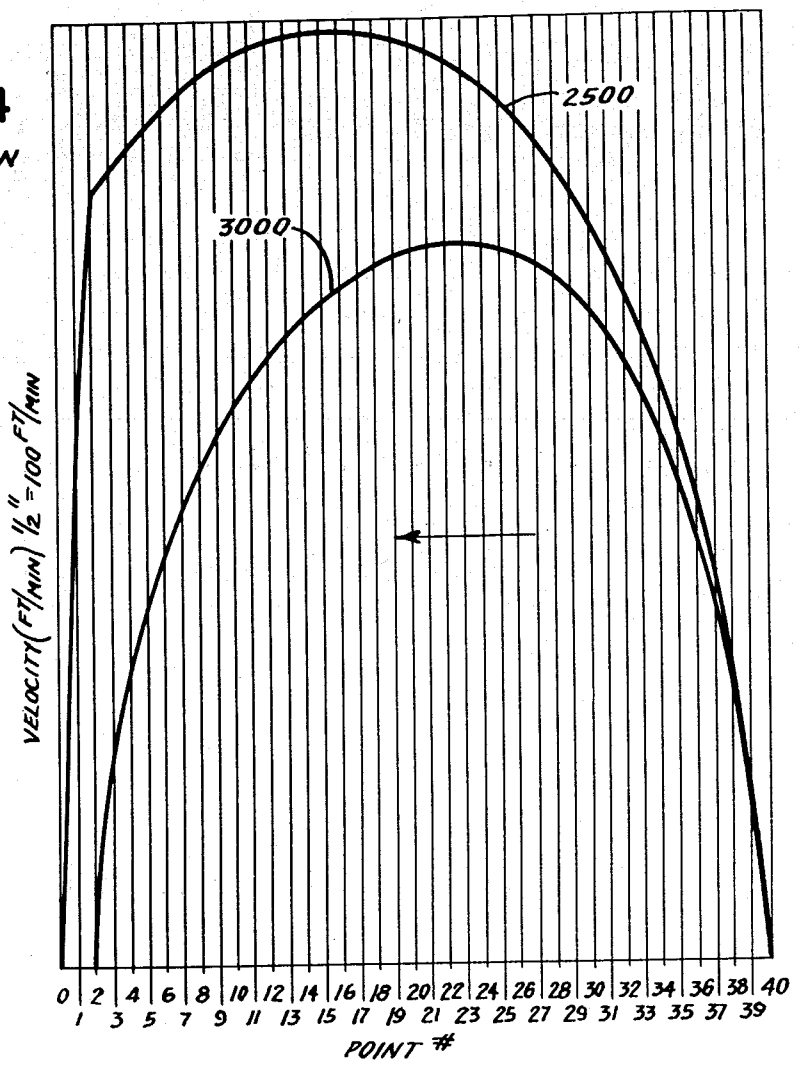
FIG. 14 shows a graphic representation of the velocities which may be involved in the power stroke of an embodiment of the present invention such as shown in FIG. 1.

FIG. 14 is a graphic representation of the velocities involved in the power stroke, these velocities being derived from the kinetic energy curves of FIG. 12. The curve "2500" represents the velocity of the combustion piston when the system pressure is at 2,500 p.s.i. Likewise the curve "3000" is for a velocity at 3000 p.s.i. These curves are derived in the same way as those in FIG. 13. It can be seen at this point, that the velocity of the power stroke at any given system pressure is approximately twice that of the compression stroke. In a conventional two cycle engine this would not be feasible, as a practical matter. It can also be seen that the velocity curve for the compression stroke is fairly flat through its highest range, thus for the compression stroke high peak velocity is avoided thereby eliminating cavitation in the pumping chamber.

It will be appreciated from a study of the geometry, that the mass of the moving parts on the needs of the engine has a positive effect. For the combustion pistons 34 to accelerate away from top dead center great acceleration of the stepped pistons 4, 6, 8 is required. The extra enertia imparted thereby aids in the achievement of constant volume combustion. This same principle applies at the end of the compression stroke where the enertia of the stepped pistons 4, 6, 8 is higher than that of the combustion pistons 34, thus the engine gets an added boost where it needs it.

Since the embodiment as illustrated does not have a direct mechanical linkage between the combustion pistons and the outside of the engine, it may be desirable to add such a connection for use in instances where it is desired to move the combustion pistons independent of engine operation. Thus, for example, if for some reason the combustion piston rods fail to pass through the 90° point into the locked position, it may be desired to so position them in order to start the engine. Another means for doing so is to introduce compressed air into the combustion cylinders 11 to force the combustion pistons into the locked position.

It will also be clear that there are many variations which are possible which will comprise practice of the present invention, and that among them are the following. All of the output pumping can be done on the back of the combustion piston leaving only the compression function to be performed by the stepped pistons. Conventional crankcase scavenging can be used, eliminating the need for the scavenging air compression pistons. The means by which the combustion piston is stopped, locked and then started on its compression stroke can be other than hydraulic; for example, it could be a spring or other resilient device which is selectively operative when the engine is running and inoperative when the engine is shut off. It is possible to supply the energy necessary for compression through both the stepped pistons and the output pumping piston behind the combustion stroke and high pressure on the power stroke. Many combustion pistons may be positioned radially around the pumping axis, connected to the stepped pistons by mechanisms utilizing substantially the same geometry as the present invention. Many stepped pistons may be positioned around the combustion axis, connected to the combustion piston in a manner comparable to that used in the present invention.

It will also be clear that the principles of this invention may be utilized in embodiments in which the combustion pistons do not pass through to a "locked" position but instead complete their respective stroke distances short of the 90° point, when they are then propelled counter-directionally into the compression phase by supplementary hydraulic pistons or other means. Further, it is possible to practice this invention in embodiments which have only one combustion cylinder and associated piston for a pair of hydraulic pump elements, instead of two opposing ones. Additionally, and particularly with such single combustion cylinder arrangements, it is possible to practice this invention with the associated hydraulic pumps oriented other than with their piston rods axially aligned on a common line; for example, lines described by their axes might form angles of greater than 90° with the axis of the combustion piston rod, since the hydraulic pumps might face toward the combustion cylinder to varying extents rather than directly toward each other.

The embodiment of the engine shown and described herein is but one of many in which the geometry shown can be used. It has the advantage of great flexibility together with a compression stroke which uses high pressure that tends to minimize fluid friction.

It will be apparent from the foregoing that an engine exhibiting performance in accordance with the foregoing curves will exhibit very advantageous efficiencies and performance, without the drawbacks of prior art devices as described in the beginning of this specification. Included among them are the following. The motion of the piston responds to the conditions of combustion rather than the rotation of a crank, or cam. The engine has a constant volume combustion capability without locking major valves. It is inherently modular for ease of maintainence and facility of ganging for large outputs. It has complete symmetry, eliminating eccentric loading and vibration and permitting high compression and piston loading. It operates at a fixed speed, generating constant pressure output. It is capable of starting against full load. The velocity of the power stroke is divorced from the velocity of the compression stroke. The engine runs in response to a loss of energy from a pressurized system and is capable of starting and stopping in response to that energy use without itself using additional energy.

It is to be understood that the embodiment of this invention herein described and shown is by way of illustration and not of limitation and that this invention may be practiced in a wide variety of other embodiments without departing materially from the spirit or scope of this invention.

I claim:

1. An improved fuel-operated device comprising a pair of combustion cylinders having pistons therein each having slidably disposed piston rods extending therefrom operatively arranged in opposing facing relation to each other such that said piston rods are urged through power strokes towards each other along a first movement path, means for admitting a gas-producing type fuel for said combustion cylinders effective to cause an initially maximum pressure expanding gas in said cylinders for powering said piston rods through said power strokes a pair of pressure transfer fluid cylinders having pistons therein each having slidably disposed piston rods extending therefrom operatively arranged in opposing facing relation to each other such that said pressure transfer fluid cylinder piston rods are urged through fluid pressure strokes away from each other along a second movement path oriented perpendicularly and in crossing relation to said first movement path, passage means connected from said pressure transfer fluid cylinders to a storage means for flowing said pressure transfer fluid thereto, an outlet connection from said storage means to a pressure fluid-operated motor for allowing said pressure transfer fluid to power said motor in operation in the performance of work utilizing said pressure transfer fluid energy, and a coupling linkage means strategically located at the intersection of said first and second movement paths operatively interconnected between said piston rods of said combustion and said pressure transfer fluid cylinders so as to produce said fluid pressure strokes in the latter in response to said power strokes of the former said coupling linkage means including pivotally interconnected links in a diamond-shaped configuration effective to initially cause an amplification of said movement occurring along said first movement path in said corresponding extent of movement occurring along said second movement path and subsequently a reversal therein whereby despite an initial maximum pressure in said expanding gas of said fuel there is produced in said fluid a pressure at a desirable starting minimum value which subsequently builds up therein to thereby contribute to the efficiency of the conversion of said fuel energy into usable pressure fluid energy.

2. An improved fuel-operated device comprising a pair of combustion cylinders having pistons therein each having slidably disposed piston rods extending therefrom operatively arranged in opposing facing relation to each other such that said piston rods are urged through power strokes towards each other along a first movement path, means for admitting a gas-producing type fuel for said combustion cylinders effective to cause an initially maximum pressure expanding gas in said cylinders for powering said piston rods through said power strokes a pair of pressure transfer fluid cylinders having pistons therein each having slidably disposed piston rods extending therefrom operatively arranged in opposing facing relation to each other such that said pressure transfer fluid cylinder piston rods are urged through fluid pressure strokes away from each other along a second movement path oriented perpendicularly and in crossing relation to said first movement path, passage means connected from said pressure transfer fluid cylinders to a storage means for flowing said pressure transfer fluid thereto, an outlet connection from said storage means to a pressure fluid-operated motor for allowing said pressure transfer fluid to power said motor in operation in the performance of work utilizing said pressure transfer fluid energy, and a coupling linkage means strategically located at the intersection of said first and second movement paths operatively interconnected between said piston rods of said combustion and said pressure transfer fluid cylinders so as to produce said fluid pressure strokes in the latter in response to said power strokes of the former said coupling linkage means including pivotally interconnected links effective to initially cause an amplification of said movement occurring along said first movement path in said corresponding extent of movement occurring along said second movement path and subsequently a reversal therein whereby despite an initial maximum pressure in said expanding gas of said fuel there is produced in said fluid a pressure at a desirable starting minimum value which subsequently builds up therein to thereby contribute to the efficiency of the conversion of said fuel energy into usable pressure fluid energy.

* * * * *